US010526108B1

(12) United States Patent
Wilson et al.

(10) Patent No.: US 10,526,108 B1
(45) Date of Patent: Jan. 7, 2020

(54) ANCHORING BOX FASTENER AND IMPROVEMENTS TO BOX FASTENING TECHNOLOGY

(71) Applicant: Eco-Latch Systems, LLC, Pewaukee, WI (US)

(72) Inventors: Jack David Wilson, Pewaukee, WI (US); Thomas Jon Wilcox, Waterford, WI (US); James Forsythe Wilson, III, Yardley, PA (US)

(73) Assignee: Eco-Latch Systems, LLC, Pewaukee, WI (US)

( * ) Notice: Subject to any disclaimer, the term of this patent is extended or adjusted under 35 U.S.C. 154(b) by 392 days.

(21) Appl. No.: 15/193,639

(22) Filed: Jun. 27, 2016

Related U.S. Application Data

(60) Provisional application No. 62/192,536, filed on Jul. 14, 2015.

(51) Int. Cl.
*B65D 5/64* (2006.01)
*E05C 19/12* (2006.01)
*B65D 5/66* (2006.01)

(52) U.S. Cl.
CPC ..... *B65D 5/643* (2013.01); *E05C 19/12* (2013.01); *B65D 5/6611* (2013.01); *B65D 5/6673* (2013.01); *Y10T 292/0862* (2015.04); *Y10T 292/17* (2015.04)

(58) Field of Classification Search
CPC .... B65D 5/643; B65D 5/6611; B65D 5/6673; E05C 19/12; Y10T 24/44274; Y10T 292/17; Y10T 292/0862
USPC ..... 292/56, 253; 227/91; 411/466
See application file for complete search history.

(56) References Cited

U.S. PATENT DOCUMENTS 279,991 A * 6/1883 Sweet ..... B65D 27/26 229/78.2
290,290 A * 12/1883 Traphagan ..... F16B 15/0015 411/478
339,507 A * 4/1886 Weihe ..... B65D 45/16 292/253
510,761 A * 12/1893 Baker ..... B65D 9/34 217/5
709,386 A * 9/1902 Young ..... B65D 5/643 229/125.37
791,198 A * 5/1905 Lettre ..... B65D 45/16 229/125.21
803,631 A * 11/1905 Sherman ..... B65D 27/26 229/78.2

(Continued)

*Primary Examiner* — Kristina R Fulton
*Assistant Examiner* — Faria F Ahmad
(74) *Attorney, Agent, or Firm* — Brannen Law Office, LLC

(57) ABSTRACT

The present invention relates to a box fastener anchor that is removably connectable or permanently attached to a fastener and that has a tooth that can pierce a box. The anchor can have a base with two lips in one embodiment. The base has a hole between the lips with a securing ring with distally located rims that combine to form a ring. The rims and lips can be used to connect the anchor to a box fastener. The base further has a base flange at one end. The anchor also has an arm with a tooth at the distal end of the arm. The tooth has a piercing element at one end. The tooth can have a curved or straight body. The arm can mate with the base to lock the arm in a closed position. A release is provided for unlocking the arm from the base.

16 Claims, 18 Drawing Sheets

(56) References Cited

U.S. PATENT DOCUMENTS 820,856 A * 5/1906 Ettinger ..... A41F 5/00 2/107
829,887 A * 8/1906 Parrish ..... B65D 9/38 217/89
843,799 A * 2/1907 Dister ..... E05C 19/06 292/19
850,195 A * 4/1907 Veeder ..... B65D 45/16 292/253
877,494 A * 1/1908 Edgington ..... B65D 9/32 217/69
884,141 A * 4/1908 Fay ..... E05C 19/18 292/253
900,557 A * 10/1908 Lathrop ..... B65D 45/16 229/125.21
915,045 A * 3/1909 Schleicher ..... B65D 45/16 229/125.01
918,387 A * 4/1909 Stollberg ..... B65D 25/32 220/769
922,104 A * 5/1909 Dister ..... B65D 45/16 292/253
925,443 A * 6/1909 Amberg ..... B65D 9/22 217/71
982,031 A * 1/1911 Canfield ..... B65D 5/6611 24/127
1,057,910 A * 4/1913 Aaberg ..... B65D 27/00 229/75
1,117,066 A * 11/1914 Leiman ..... B65D 9/32 217/56
1,177,615 A * 4/1916 Cebhardt ..... B65D 9/32 217/70
1,188,007 A * 6/1916 Moreland ..... B65D 45/16 292/253
1,206,551 A * 11/1916 Lederer ..... B65D 27/26 229/78.2
1,217,668 A * 2/1917 Trumbower ..... B65D 45/16 229/125.23
1,318,628 A * 10/1919 Warren ..... B65D 5/68 229/125.23
1,411,734 A * 4/1922 Klossner ..... B65D 43/0222 217/89
1,431,134 A * 10/1922 Young ..... B65D 5/68 292/253
1,435,589 A * 11/1922 Davis ..... B65D 5/68 229/125.21
1,438,950 A * 12/1922 Ehmann ..... B65D 9/34 217/70
1,565,898 A * 12/1925 Boutelle ..... B65D 5/68 292/253
1,610,320 A * 12/1926 Redemski ..... B65D 5/643 229/125.39
1,669,279 A * 5/1928 Berthold ..... B65D 5/68 229/125.21
1,716,348 A * 6/1929 Smelzer ..... B65D 5/68 229/125.21
1,774,850 A * 9/1930 Snook ..... B65D 45/16 292/210
1,829,598 A * 10/1931 Lind ..... B65D 45/20 292/120
1,871,481 A * 8/1932 Trimbach ..... F16B 15/04 16/404
1,909,654 A * 5/1933 Brown ..... B65D 5/6647 24/356
1,934,974 A 11/1933 Grand
1,953,322 A * 4/1934 Weller ..... B65D 5/68 229/125.21
1,958,652 A * 5/1934 Wrye ..... B65D 27/22 229/78.2
2,018,629 A * 10/1935 Berthold ..... B65D 5/68 229/125.21
2,028,661 A * 1/1936 Gustafson ..... B65D 5/68 229/125.21
2,281,519 A * 4/1942 Faber ..... E04F 13/085 411/466
2,282,624 A * 5/1942 Upson ..... E04B 2/58 411/466
2,282,631 A * 5/1942 Winship ..... E04B 2/58 248/217.3
2,297,771 A * 10/1942 Johnson ..... B65D 5/643 229/125.37
2,317,825 A * 4/1943 Teas, Sr. ..... F16L 3/04 248/62
2,463,306 A * 3/1949 Potts ..... B65D 5/46016 16/404
2,536,941 A * 1/1951 Jones ..... E05C 19/182 292/1
2,537,801 A * 1/1951 Swatsick ..... B65D 5/68 229/125.21
2,616,142 A * 11/1952 Tinnerman ..... F16B 2/241 24/458
2,674,149 A * 4/1954 Benson ..... F16B 15/04 411/473
2,688,507 A * 9/1954 Ashworth ..... F16B 5/0657 2/96
2,703,915 A * 3/1955 Markin ..... A44B 13/0017 24/689
2,828,905 A * 4/1958 Frizzell ..... B65D 5/448 229/125.38
2,879,097 A 3/1959 Hendee
2,918,319 A * 12/1959 Richardson ..... B65D 55/06 229/125.23
2,973,175 A * 2/1961 Appleton ..... H02G 3/125 248/217.2
3,001,254 A * 9/1961 Schumm ..... B65D 33/1675 132/273
3,031,727 A * 5/1962 Neshitt ..... E04B 1/49 227/152
3,071,827 A * 1/1963 Van Buren, Jr. .... E04F 13/0835 411/458
3,077,251 A * 2/1963 Fraylick ..... F16B 5/123 24/347
3,097,821 A * 7/1963 Richards ..... H02G 3/10 174/58
3,233,730 A * 2/1966 Winters ..... B65D 71/16 206/159
3,266,362 A * 8/1966 Carr ..... F16B 15/0046 411/466
3,276,663 A * 10/1966 Falconer ..... B65D 5/4283 229/117.23
3,313,463 A * 4/1967 Boucher ..... A47G 27/0487 227/108
3,417,652 A * 12/1968 Menge ..... E04B 1/49 411/466
3,447,823 A * 6/1969 Gregoire ..... E04D 3/3607 248/217.3
3,472,118 A * 10/1969 Jureit ..... E04B 1/49 411/466
3,529,918 A * 9/1970 Jureit ..... E04B 1/49 403/384
3,545,801 A 12/1970 Barsness
3,707,023 A * 12/1972 Pfaffendorf ..... B65D 5/6611 206/805
3,908,850 A * 9/1975 Jureit ..... B65D 71/04 206/453
4,021,890 A * 5/1977 Kurosaki ..... F16B 2/02 16/443
4,024,977 A * 5/1977 Rowley ..... B65D 9/24 217/12 R
4,235,148 A * 11/1980 Menge ..... F16B 15/0046 411/466
4,339,983 A * 7/1982 Okamura ..... B25C 5/00 411/466
4,368,839 A 1/1983 Okamura et al.
4,439,970 A * 4/1984 Rosner ..... E04F 13/0816 411/461
4,464,821 A * 8/1984 Haytayan ..... B22D 7/108 164/137

(56) References Cited

U.S. PATENT DOCUMENTS 4,554,773 A * 11/1985 Conley ..... E04D 3/365 24/23 W
4,609,125 A * 9/1986 Willingham ..... B65D 45/18 220/324
4,641,474 A * 2/1987 Cannarsa ..... E04F 13/0892 52/514
4,712,816 A * 12/1987 Mueller ..... E05B 65/0014 292/253
4,761,935 A * 8/1988 King ..... B65D 5/6605 229/125
4,768,704 A * 9/1988 Beckway ..... B65D 5/6673 229/125.22
4,803,823 A * 2/1989 Stenson ..... E04D 3/3603 403/218
4,807,334 A * 2/1989 Blanchard ..... A44B 99/00 223/91
4,865,280 A * 9/1989 Wollar ..... F16L 3/23 248/68.1
4,935,998 A * 6/1990 Frazier ..... A47C 31/06 24/347
5,098,243 A * 3/1992 Buck ..... B68G 7/10 411/457
5,116,179 A * 5/1992 Matlock ..... F16B 15/0046 411/466
5,516,036 A * 5/1996 Maultasch ..... B65D 5/445 229/125.39
5,531,052 A * 7/1996 Agar ..... E04B 2/7453 411/461
5,619,836 A * 4/1997 Rouch ..... E04G 23/0203 52/715
5,820,048 A * 10/1998 Shereyk ..... F16L 3/1215 248/68.1
5,833,421 A * 11/1998 Lees ..... B21D 31/02 411/466
5,937,745 A * 8/1999 Boe ..... H02G 3/26 100/2
6,193,455 B1 * 2/2001 Levey ..... F16B 37/048 411/179
6,272,722 B1 * 8/2001 Lai ..... H01L 23/4093 24/458
6,290,126 B1 * 9/2001 Zudal ..... B65D 5/4283 229/125.39
6,340,182 B1 * 1/2002 Kaneda ..... B65D 5/4283 292/102
6,989,186 B2 * 1/2006 Haygood ..... A47C 31/026 428/99
7,284,688 B1 10/2007 Barsness
7,387,282 B2 * 6/2008 Kovac ..... B60R 16/0215 248/55
7,721,400 B2 * 5/2010 Parent ..... B25C 11/00 144/330
8,561,950 B2 * 10/2013 Li ..... H02G 3/32 248/73
8,672,600 B2 * 3/2014 Reznar ..... E04F 15/04 411/457
8,840,010 B2 9/2014 Wilson
8,998,071 B2 * 4/2015 Sublett ..... B65D 5/6611 229/125.39
9,857,086 B2 * 1/2018 Michiels ..... F16L 3/1075
2004/0223831 A1 * 11/2004 Whitaker ..... B60Q 1/0441 411/466
2014/0346218 A1 * 11/2014 Sublett ..... B65D 5/6611 229/125.39

* cited by examiner

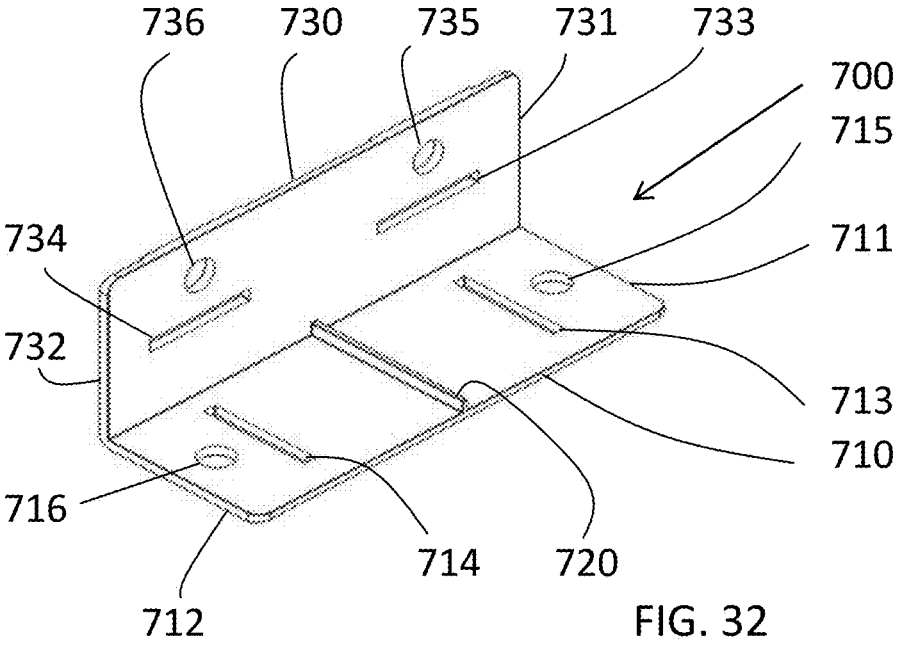
FIG. 32
FIG. 33
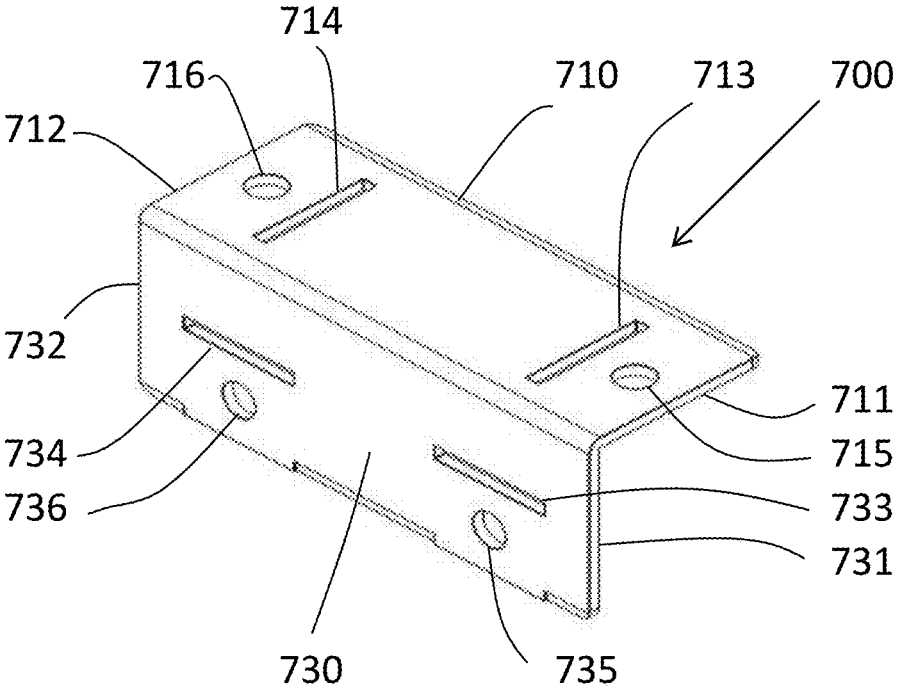

FIG. 34
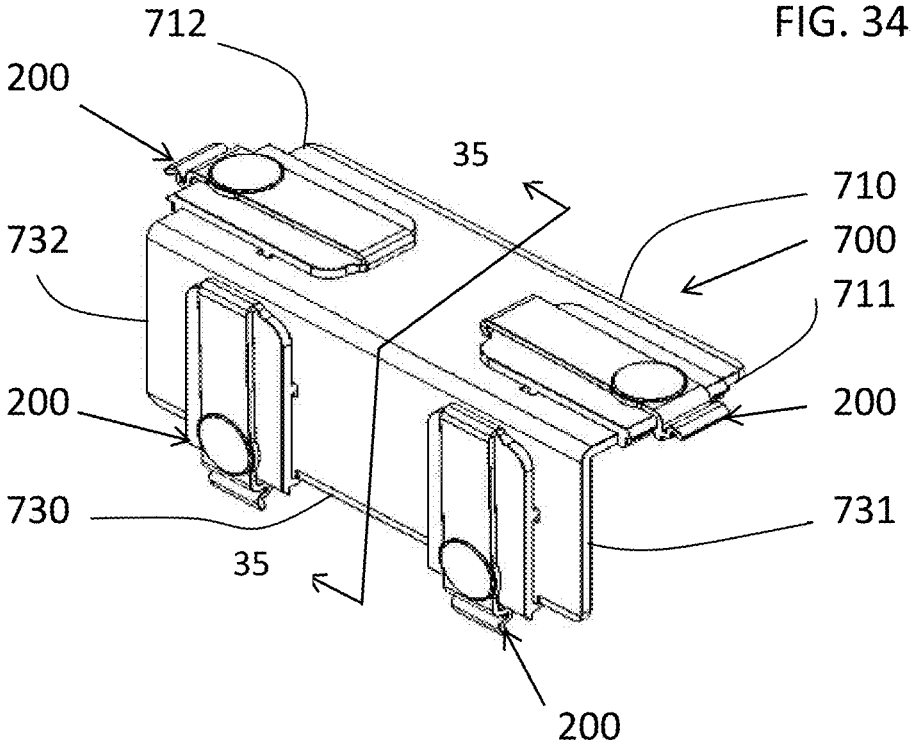
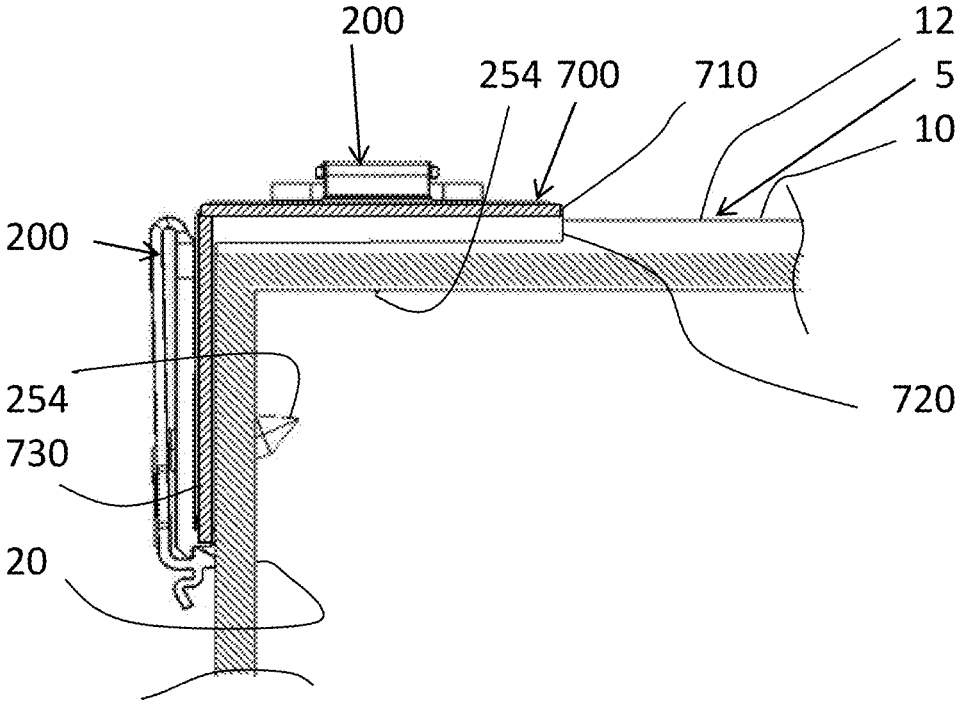
FIG. 35

ANCHORING BOX FASTENER AND IMPROVEMENTS TO BOX FASTENING TECHNOLOGY

This United States utility patent application claims priority on and the benefit of provisional application 62/192,536 filed Jul. 14, 2015, the entire contents of which are hereby incorporated herein by reference.

BACKGROUND OF THE INVENTION

1. Field of the Invention

The present invention relates to a box fastener anchor that is removably connectable or permanently attached to a fastener and that has a tooth that can pierce a flap of a box, and also to improvements in box fastener technology.

2. Description of the Related Art

Several methods of closing or sealing a box exist.

In one method, the corners of successive flaps are tucked under one another. While this may be a simple solution, it does not offer an effective seal and is subject to the limits of the box flap stiffness and integrity which can degrade over time and in particular when a corner is bent.

In another method, tape is used to seal the box. While this can be an effective sealing method, the tape is only a single use product and its removal often leads to damage of the box.

Further, box fasteners have been developed over the years. One such device, invented by Jack D. Wilson, one of the inventors of the present invention, is shown in U.S. Pat. No. 8,840,010 titled Reusable Box Closure for Holding Box Flaps. It shows a box closure device that engages and holds the flaps of a box in their downward closed position. The device is constructed in a general "I" shape such that the top member is parallel and connected to a bottom member by a vertical member. It slides inward between the opposing flaps of a box from one (or either) side of the box with the "I-beam" connecting member of the device fitting in the space between the flaps. The top and bottom members are of sufficient length, width and depth to hold the box closed. The device gains further operative value when promotional or box content labels, business cards, displays, signage, decor, pictures or the like are applied to the surface of the top and/or bottom members of the said device.

Other examples include:

U.S. Pat. No. 1,177,615 to Cebhardt titled Box Fastener.

U.S. Pat. No. 1,934,974 to Grand titled Filing Case.

U.S. Pat. No. 2,879,097 to Hendee titled Fastener for Boxes and the Like.

U.S. Pat. No. 3,545,801 to Barsness titled Box Closure Fastening. It shows a fastening means at substantially the center of a cardboard or corrugated board box grasps two or preferably four flaps and holds them closed.

U.S. Pat. No. 4,021,890 to Kurosake is titled Linking Device for Uniting Two Plates in Abutment. It shows a linking device that is disclosed which comprises a connecting strip, a main trunk section formed integrally at each end of said connecting strip and an engaging member formed by extending the forward perpendicular end of said each main trunk section into an inserting and engaging portion integrally incorporating a hook element of the shape of a hook. Butting union for two covering flaps of a container is accomplished by having perforations bored in advance one in each of said covering flaps at opposed positions across the butting edges of said covering flaps, inserting said inserting and engaging portions into said opposed perforations and pressing said main trunk sections downwardly, whereby the inserting and engaging portions advance through the perforations until the tips of said hook elements collide into the covering flaps on the edges of said perforations and, in consequence of said collision, the inserting and engaging portions are caused to advance in inwardly bent directions, causing said hook elements and the corresponding inserting and engaging portions to take firm grip of said edges of the respective perforations in the covering flaps.

U.S. Pat. No. 4,368,839 to Okamura et al. is titled Fastener Applying Device Having a Plurality of Sliders and relates to a device for fixing fasteners to the flaps of corrugated cardboard boxes for sealing the flaps. With the fastener placed across the adjoining edges of at least two flaps, piercing nails in the form of a cow horn and attached to a pair of turnable pieces on the fastener are driven into the flaps by the device. The device is characterized in that two reciprocally movable sliders (12, 13) move to drive a cutting blade (17), causing the blade to separate a fastener from other fasteners, and subsequently drive pivotal members (29a, 29b) to depress the turnable pieces on the fastener, driving the piercing nails into the flaps. Fasteners can be fixed in place easily and reliably.

U.S. Pat. No. 4,761,935 to King et al. is titled Device for Retaining Carton Flaps in Closed or Open Position. It shows that a holder for flaps of corrugated cartons is designed to temporarily hold carton flaps either in the fully opened position, for loading or unloading, or in a temporarily closed position. The device acts as a clip, with two flanges between which one or two layers of corrugated board may be engaged. The clip preferably is formed of one integral piece, with one flange being substantially the size of a large central opening in the other flange. The inner flange may have a rest position which extends slightly through the opening of the outer flange, so that the clip always tends to spring back to this position and will exert a clamping force on the carton flaps.

U.S. Pat. No. 7,284,688 to Barsness is titled Box Closure with Hinged Tab. It shows that a box closure device releasably engages the flaps of a box in a closed configuration. The device has a lower element which extends generally in a first plane. An upper element is connected to the lower element and spaced substantially parallel to it by a central stem, such that portions of the box flaps are engaged between the upper and the lower element. A tab is connected to the upper element along a living hinge and is pivotable about the hinge from a first position extending substantially in the same plane as the upper element, to a second position which extends upwardly from the upper element, such that the tab may be engaged to assist in the rotation of the device when being installed in a box, and, when released, the tab returns to the first position. The lower element may be a planar disc, or may be cupped.

While the devices shown in each of the above patents may work well for their intended purposes, none show the present invention. Further, none show the advantages of the present invention.

Thus there exists a need for a box fastener anchor and for other box fastener technology that solves these and other problems.

SUMMARY OF THE INVENTION

The present invention relates to a box fastener anchor that is removably connectable or permanently attached to a fastener and that has a tooth that can pierce a box. The anchor can have a base with two lips in one embodiment. The base has a hole between the lips with a securing ring with distally located rims that combine to form a ring that combines to form a ring that holds the anchor in place as it pierces the corrugate and enters the side rail of the box fastener. The rims and lips can be used to connect the anchor to a box fastener. The base further has a base flange at one end. The anchor also has an arm with a tooth at the distal end of the arm. The tooth has a piercing element at one end. The tooth can have a curved or straight body. The arm mates with the base to lock the arm in a closed position. A release is provided for unlocking the arm from the base.

According to one advantage of the present invention, boxes used with the present invention can be reused many times. Reusing of boxes is one way to reduce waste as each reused box eliminates the need to create a new box to replace it.

According to another advantage of the present invention, the box is securely fastened and remains closed even if the box is placed upside down or if the fastener is used on the bottom flaps of the box. This is advantageously accomplished as the piercing elements prevent the box flaps from slipping relative to the fastener. This also allows the box fasteners with anchors to be removed or left in place as desired over one flap so the boxes can be flattened for storage and/or returned to the location from where they were shipped.

According to one advantage of the present invention, the anchor is useful to prevent and/or reduce tenting of a box. The tenting can occur if and when the box flaps are resilient and the flap memory or resiliency causes the flaps to attempt to open. Opening of the flaps causes the flaps to slip a little bit relative to the fastener. Advantageously, the anchor fixes the box fastener in place preventing slippage between the flaps and the box fastener thereby preventing and/or reducing tenting and/or opening of the flaps.

According to another advantage of the present invention, the anchor prevents sliding or movement of the fastener when the anchor is fastened to a box flap. This is accomplished in one embodiment by having the anchor pass through a siderail of the box fastener.

According to a further advantage of the present invention, the anchor has a piercing tooth. The tooth has a piercing element at one end. The piercing element is sharp and can penetrate cardboard and plastic flaps. It is understood that in some particularly robust or pierce resistant boxes, holes could be pre-pierced, pre-drilled or otherwise preformed.

Related, the length, diameter and/or profile of the tooth can be predetermined based on the intended use of the anchor. For example, the piercing element can either extend through the box or box flap or can terminate within the box or box flap whereby the piercing element doesn't extend into the interior of the box if it is desired that the piercing element not enter the box.

According to a still further advantage of the present invention, the tooth has a body that can be curved. This advantageously allows the tooth to pass through a round hole as the arm is pivoted relative to the base as the tooth swings along an arc as the radius of curvature of the tooth is generally equal to the arc radius.

Related, the curved tooth, by virtue of its shape, is resistant to being pulled purely vertically from a box flap (due to the curved design of the tooth).

In another embodiment, the tooth can be generally straight and is receivable through a hole that can be oversized (relative to the tooth) such as a slot or enlarged hole.

According to a still further advantage yet of the present invention, the anchor is removably connectable to a side rail of a box fastener. In one embodiment, the connection has a secure three point engagement between the fastener and anchor (two lips and one securing ring).

According to a still further advantage yet of the present invention, the anchor is lockable in a closed position. This allows the anchor to be used indefinitely without the need for adhesives. Related, a release is provided for easily unlocking the anchor wherein the tooth can be removed from the box.

According to a still further advantage yet of the present invention, the anchor is reusable.

The present invention also relates to improvements in box fastener technology such as box fasteners generally.

In one embodiment, an improved box fastener is provided that has a top with upper and lower pieces that cooperate to receive the box flaps, as well as a side that can interface with one or more anchors to be secured to the side of the box.

In another embodiment, an improved box fastener is provided having both a top and a side that can interface with anchors. In this regard, the improved box fastener secures or is anchored to both top flaps of a box as well as the side of the box.

According to an advantage of both of these two embodiments, a central web or divider is provided that fits between the facing edges of the box flaps. This feature provides lateral stability to the box as well as aids in proper placement of the box fastener and providing structural integrity to the fastener.

According to another advantage of these embodiments, the anchors on the side of the box fastener fix the box fastener in relation to the box so that the flaps contained within the top section cannot move thereby preventing and/or reducing tenting of the box by having multi-side anchoring of the box.

In yet another embodiment, the present invention can have one or more anchors integrated into the box fastener. Having a single or unitary structure advantageously allows device to be used and stored without assembly/disassembly and also eliminates the risk that an anchor could become inadvertently disassembled or lost.

In yet a still further embodiment, a piercing element can be provided having a generally cross shaped profile wherein piercing ability is enhanced, the arm is structurally rigid and wear to the respective box is minimized.

Other advantages, benefits, and features of the present invention will become apparent to those skilled in the art upon reading the detailed description of the invention and studying the drawings.

BRIEF DESCRIPTION OF THE DRAWINGS

FIG. 32 is a perspective view of an alternative embodiment of a box fastener.

FIG. 33 is an additional perspective view of the box fastener illustrated in FIG. 32.

FIG. 34 is a perspective view of the embodiment illustrated in FIG. 32 but additionally shows anchors in place.

FIG. 35 is an end cross-sectional view showing the box fastener fastened to a box taken along line 35-35 in FIG. 34.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
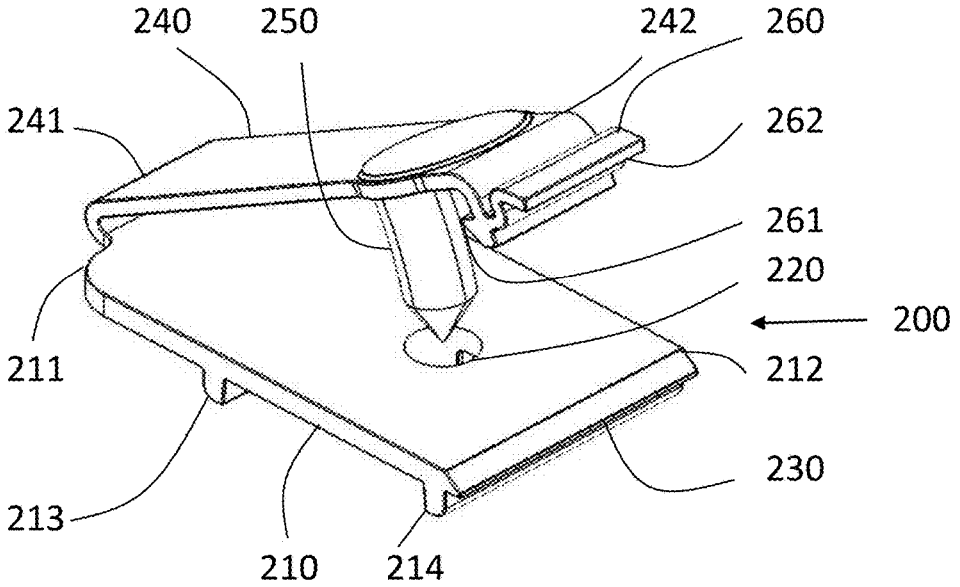
FIG. 1 is a perspective view of a preferred embodiment of an anchor shown in an unfastened position.
Figure 2:
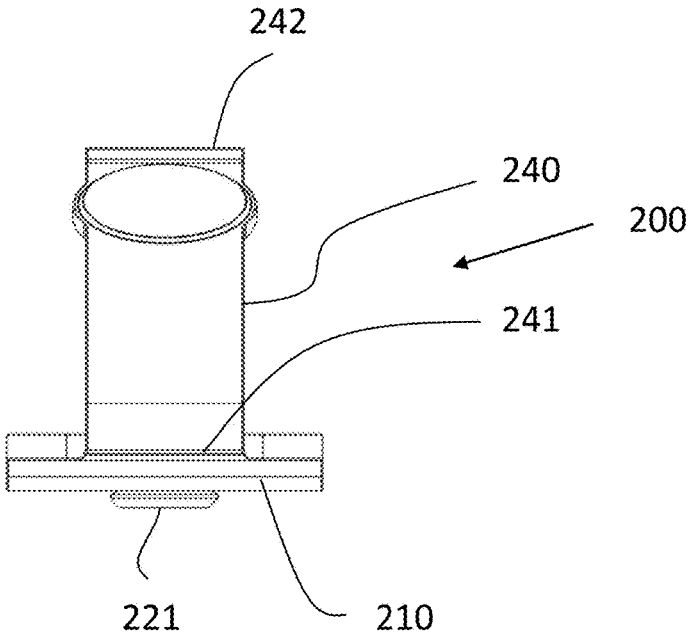
FIG. 2 is an end view of the embodiment illustrated in FIG. 1.
Figure 3:
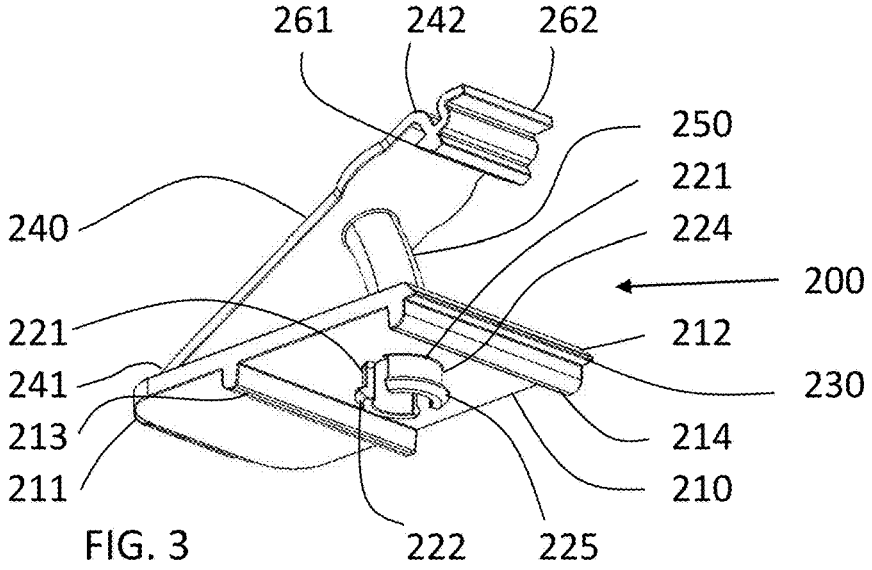
FIG. 3 is an additional perspective view of the embodiment illustrated in FIG. 1.
Figure 4:
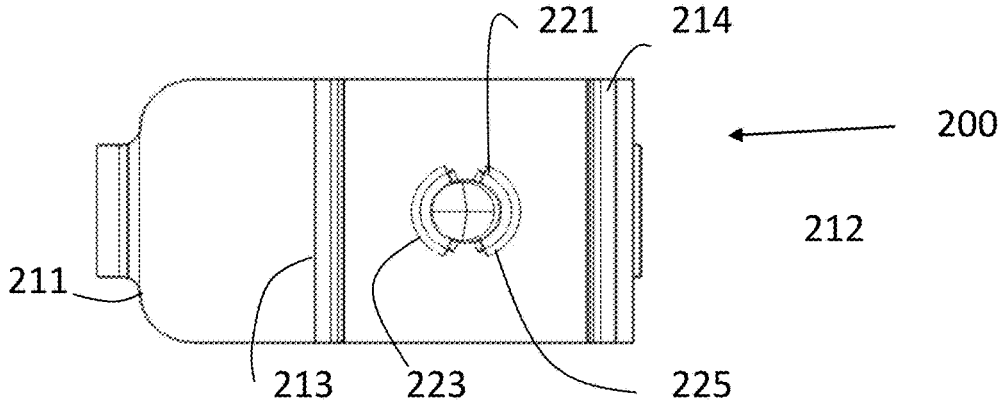
FIG. 4 is a bottom view of the embodiment illustrated in FIG. 1.
Figure 5:
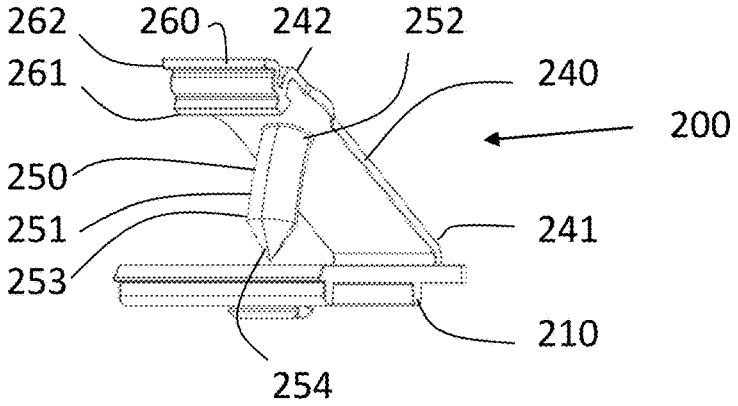
FIG. 5 is an additional perspective view of the embodiment illustrated in FIG. 1.
Figure 6:
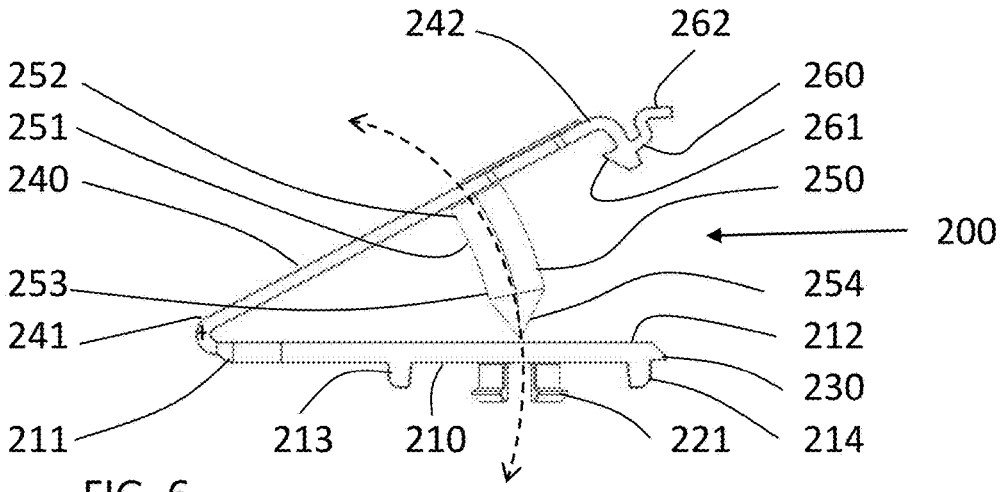
FIG. 6 is a side view of the embodiment illustrated in FIG. 1.
Figure 7:
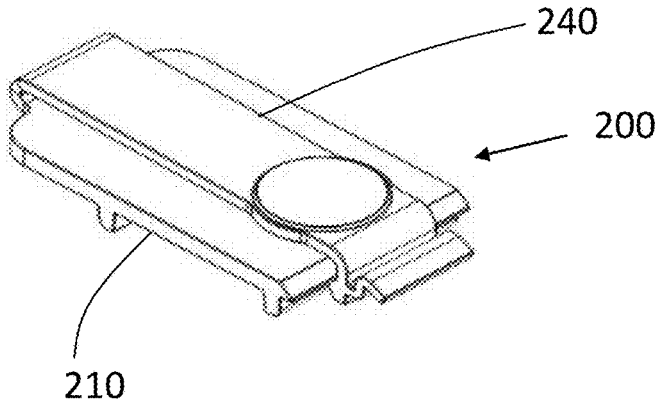
FIG. 7 is a perspective view showing the embodiment of FIG. 1 in a fastened position.
Figure 8:
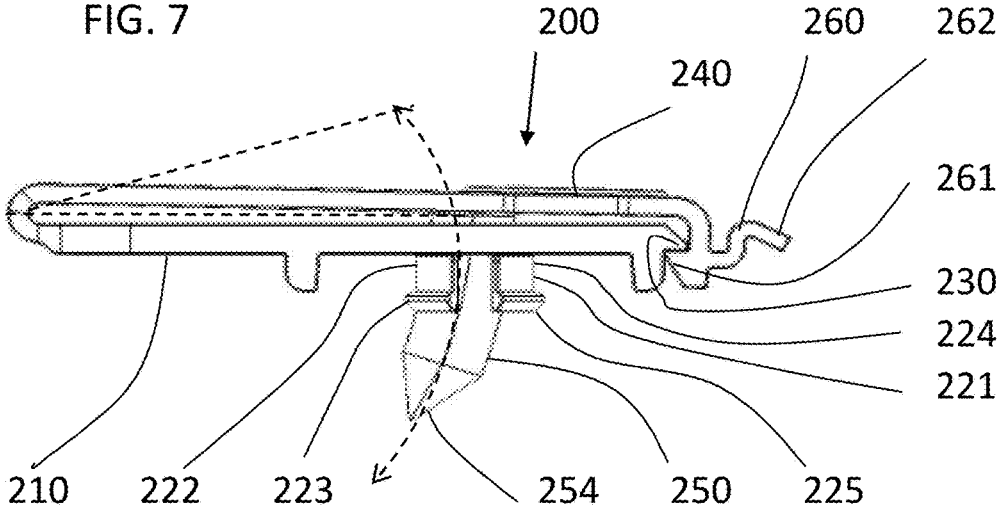
FIG. 8 is a side view of the embodiment illustrated in FIG. 7.
Figure 9:
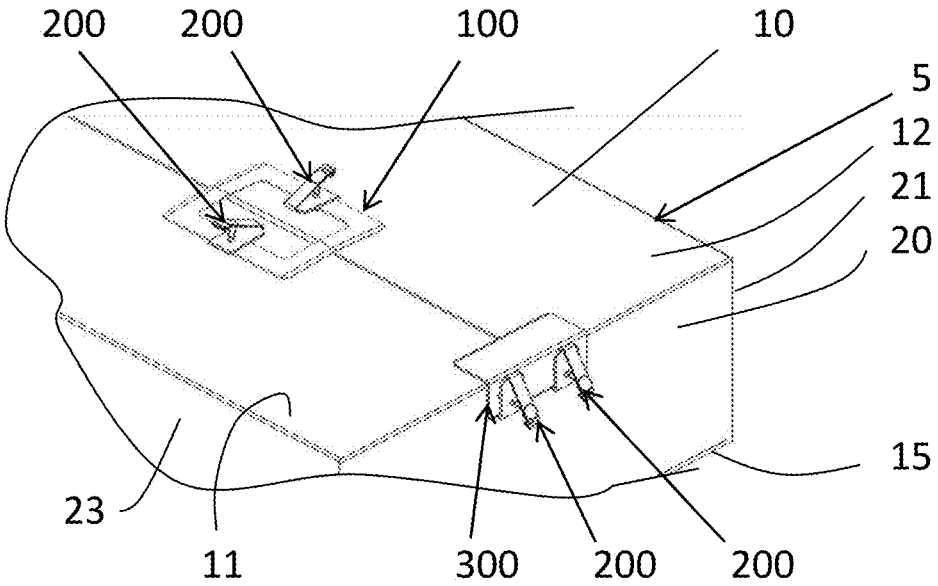
FIG. 9 is a perspective view of a box shown with two embodiments of a box fastener showing the anchors in the unfastened position.
Figure 10:
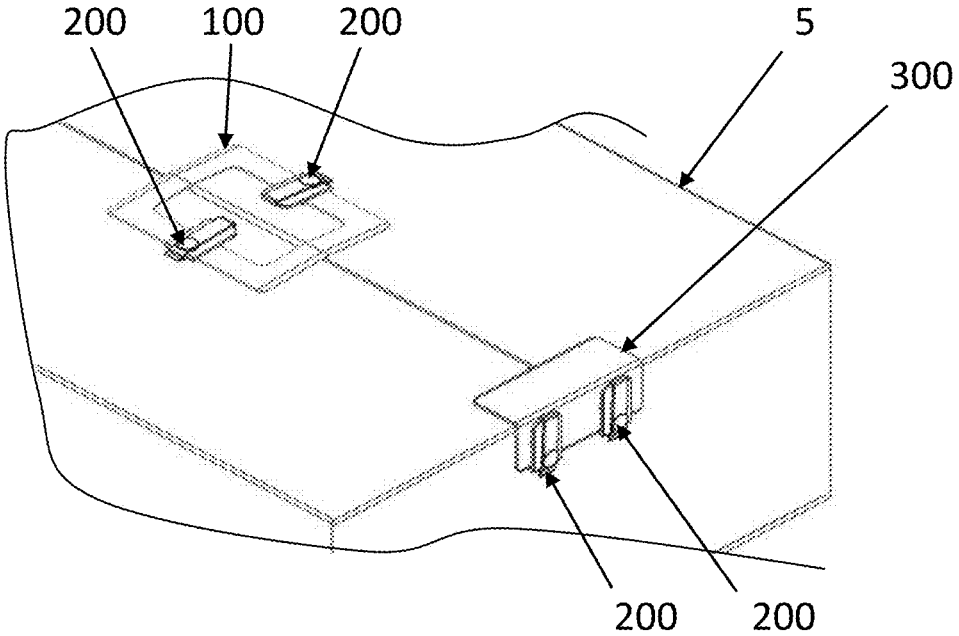
FIG. 10 is similar to FIG. 9, but shows the anchors illustrated in the fastened position.
Figure 11:
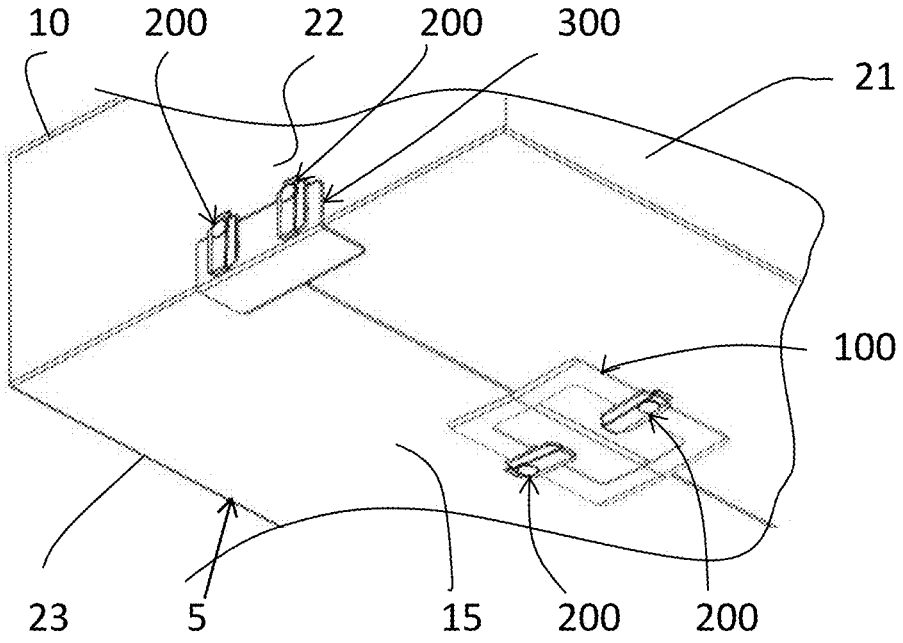
FIG. 11 is a perspective view showing anchors used to secure a bottom side of a box.
Figure 12:
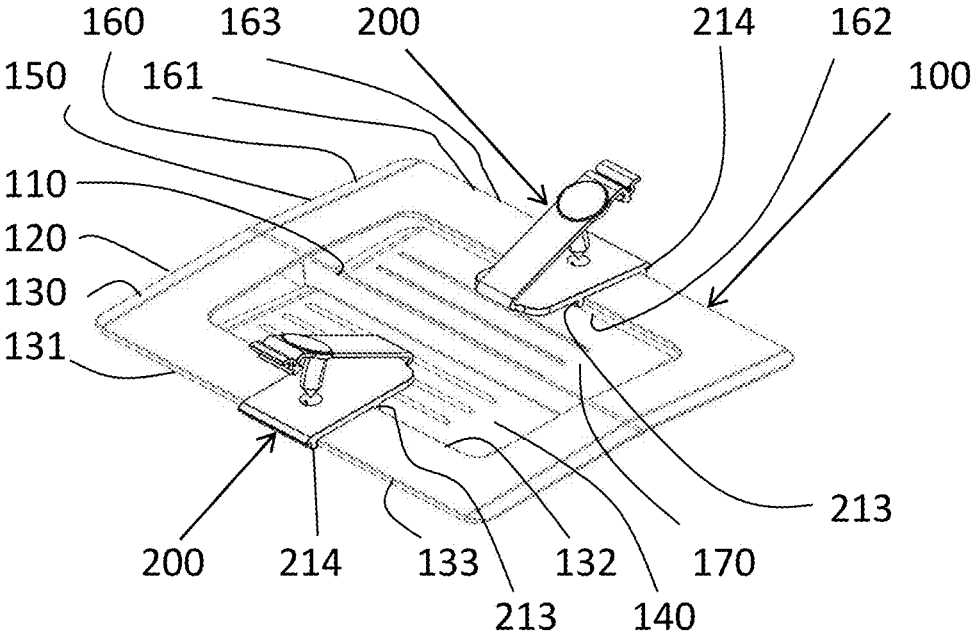
FIG. 12 is a perspective view showing two anchors interfacing with an embodiment of a box fastener, showing the anchors in the unfastened position.
Figure 13:
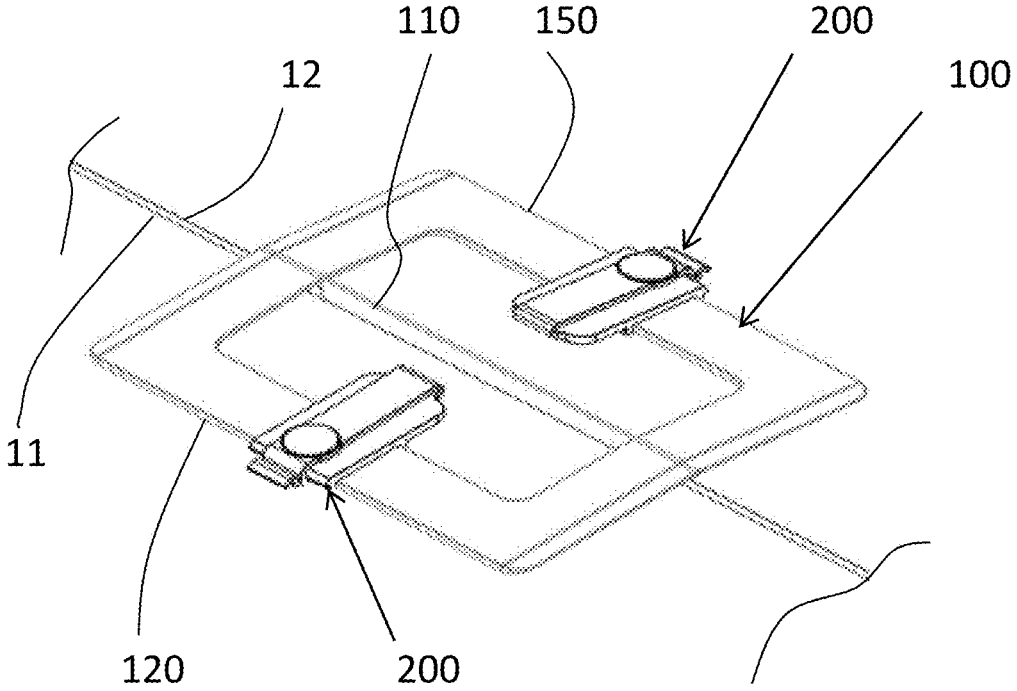
FIG. 13 is similar to FIG. 12, but shows the anchors in a fastened position.

The embodiments of the present invention are useful to secure a box 5 in a closed position. An exemplary box 5 is illustrated in FIGS. 9-11. The box 5 has a top 10 with outer flaps 11 and 12, respectively. The outer flaps 11 and 12 are sometimes referred to as major flaps. The box 5 also has inner flaps that are sometimes referred to as minor flaps. In a closed position, the major flaps 11 and 12 are flat at the top 10 of the box and lie in planes parallel to each other. A bottom 15 is also provided, and is similar in structure to the box top 10. The box 5 further has sides 20, 21, 22 and 23 respectively. It is appreciated that the boxes for use with the present invention can be made of various materials (such as card board, plastic, or otherwise) and that the thicknesses of the parts of the box can vary without departing from the broad aspects of the present invention.

Figure 14:
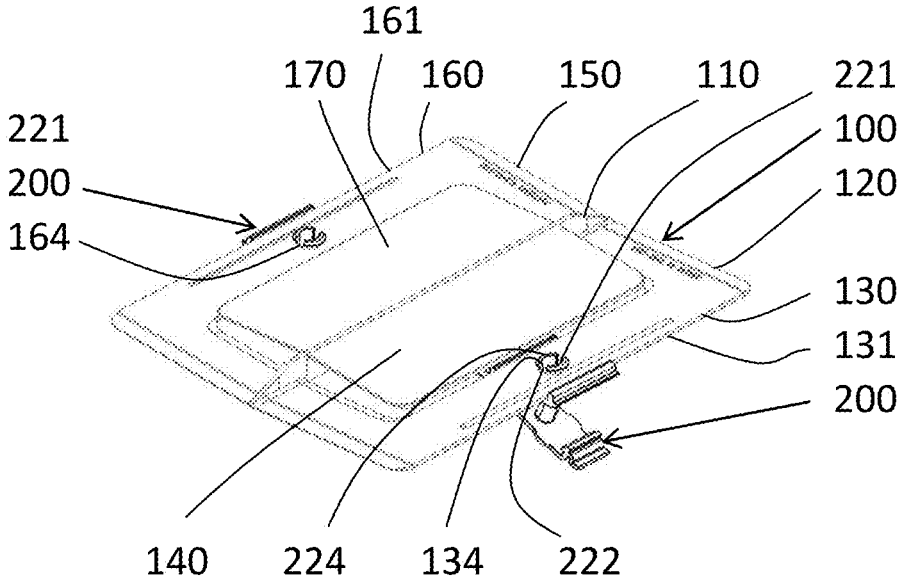
FIG. 14 is a bottom perspective view of the embodiment illustrated in FIG. 12.
Figure 15:
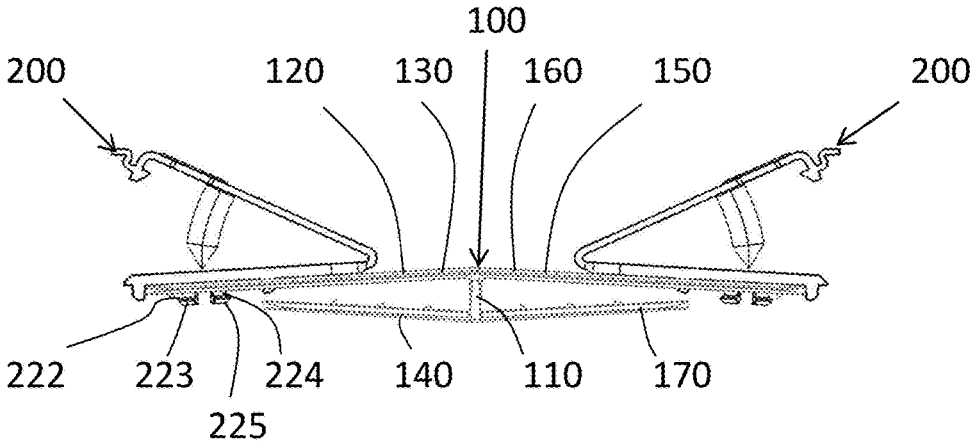
FIG. 15 is a side view of the embodiment illustrated in FIG. 12.
Figure 16:
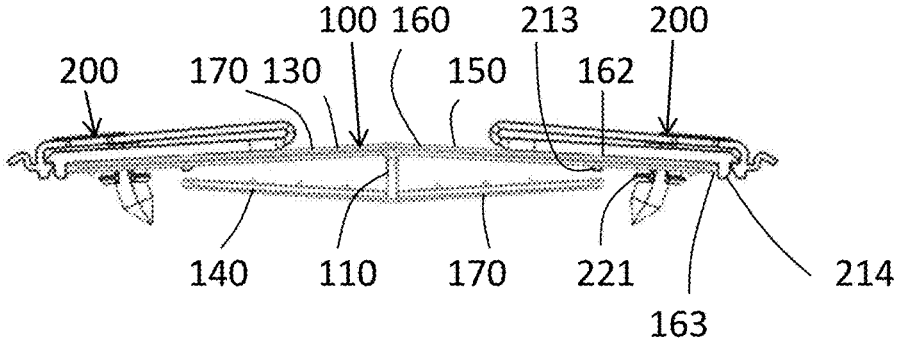
FIG. 16 is similar to FIG. 15, but shows the anchors illustrated in the fastened position.

Turning now to FIGS. 12-16, it is seen that an embodiment of a box fastener 100 is illustrated. The fastener 100 has a web 110 that is centrally aligned. The web 110 separates the box fastener 100 into a first side 120 and a second side 150. The first side 120 has a top piece 130 with an outer rail 131 and two return portions that connect to the web. The outer rail 131, or rail, has an inner side edge 132 closer to the web 110 and an outer side portion 133 distal from the web 110. A hole 134 is formed through the rail 131 between the inner side edge 132 and outer side edge 133. The hole 134 is preferably located longitudinally equidistant from the two ends of the rail 131 as seen in FIG. 14. The first side further has a bottom piece 140. A major flap of the box can be sandwiched or received between the top piece 130 and the bottom piece 140.

The second side 150 also has a top piece 160 with a rail 161 and two return portions that connect to the web 110. The rail 161 has an inner side edge 162 closer to the web 110 and an outer side edge distal from the web 110. A hole 164 is formed through the rail 161 between the inner side edge 162 and outer side edge 163. The hole 164 is preferably located longitudinally equidistant from the two ends of the rail 161 as seen in FIG. 14. The first side further has a bottom piece 170. A major flap of the box can be sandwiched or received between the top piece 160 and the bottom piece 170.

Figure 17:
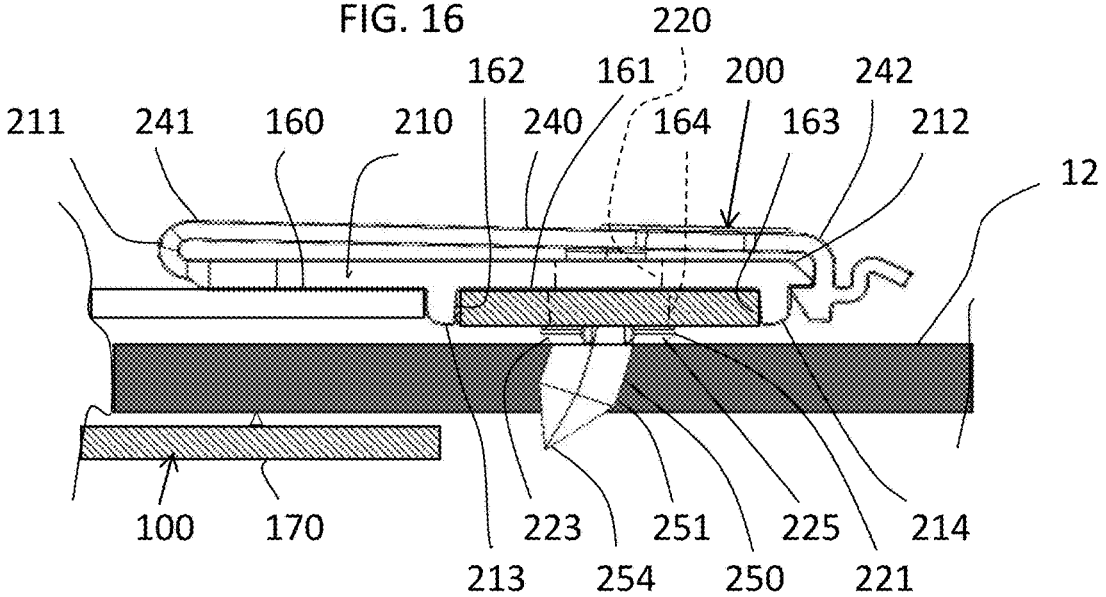
FIG. 17 is a close up view showing the right side portion of the fastener with an anchor interfacing with a box fastener and piercing a box flap.
Figure 18:
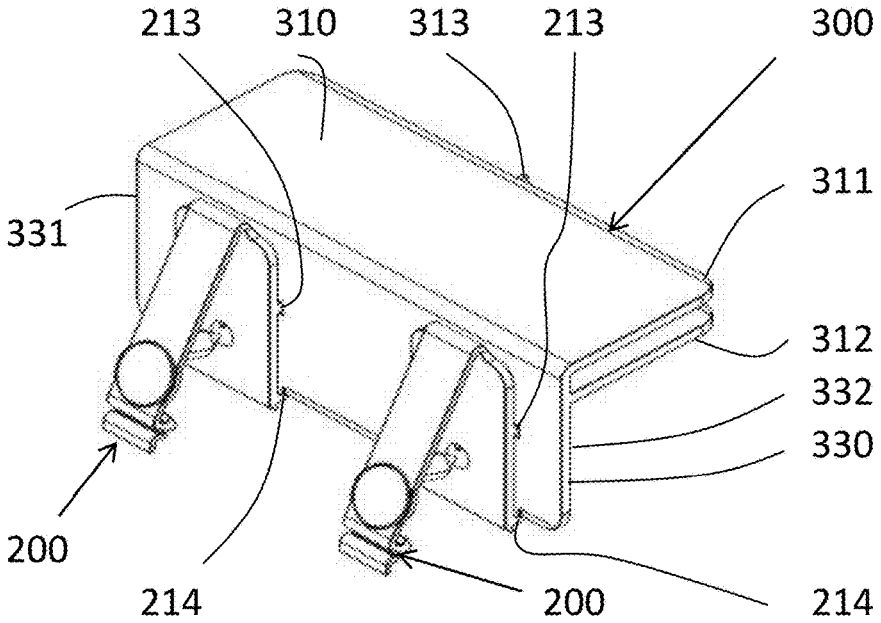
FIG. 18 is a perspective view of an alternative embodiment of a box fastener of the present invention.
Figure 19:
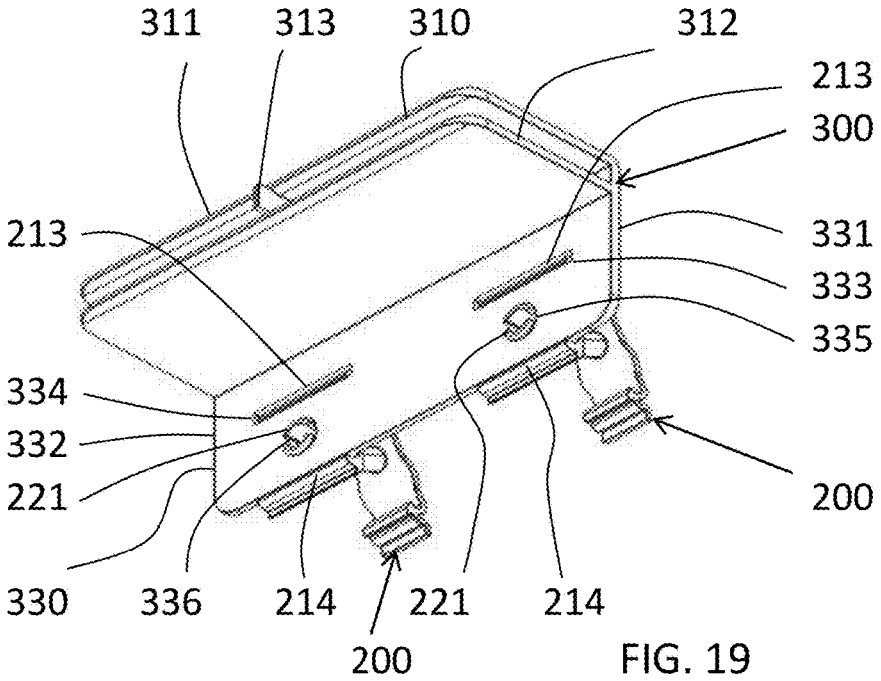
FIG. 19 is an additional perspective view of the embodiment illustrated in FIG. 18.
Figure 20:
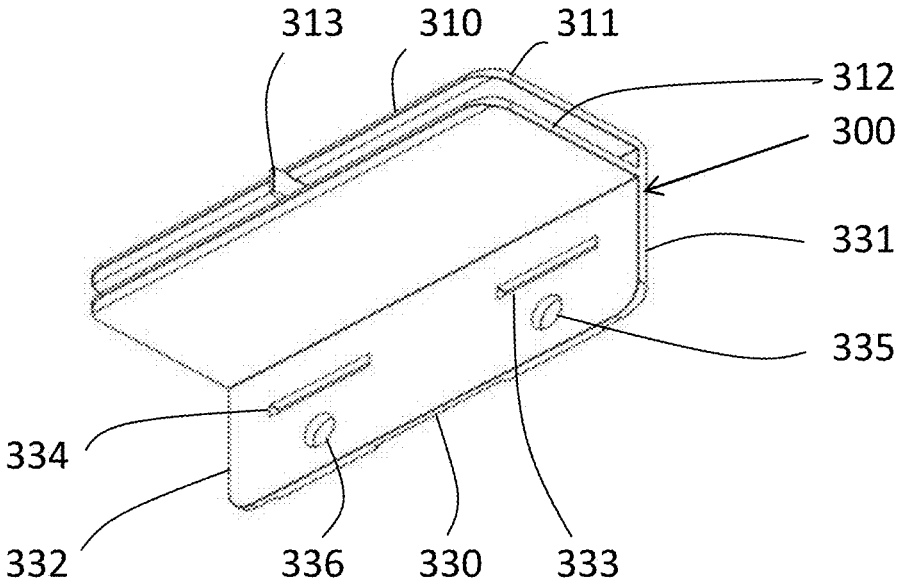
FIG. 20 is a perspective view of an embodiment of the present invention illustrated in FIG. 18, but shown without anchors.
Figure 21:
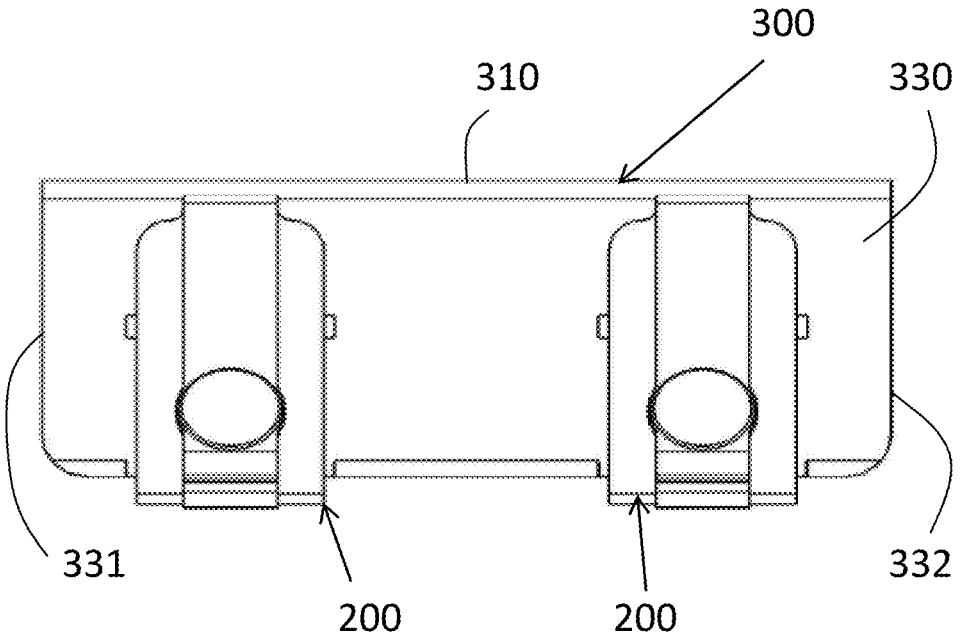
FIG. 21 is a side view of the box fastener illustrated in FIG. 18.
Figure 22:
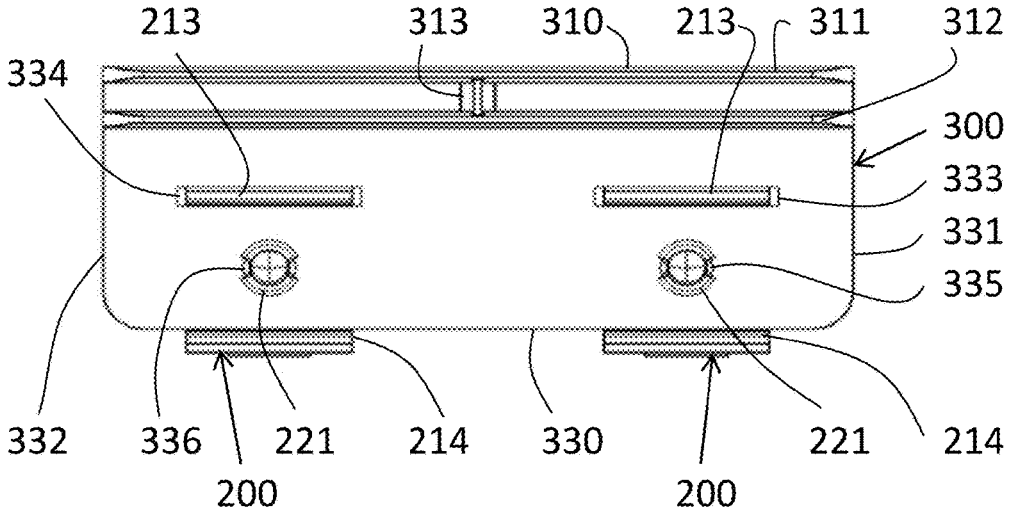
FIG. 22 is a reverse side view of the box fastener illustrated in FIG. 18.
Figure 23:
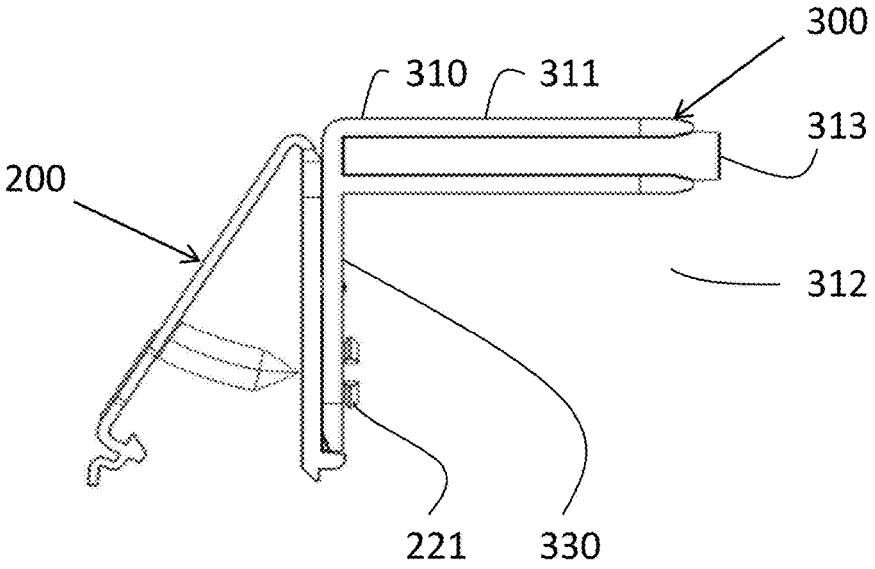
FIG. 23 is an end view of the embodiment illustrated in FIG. 18.
Figure 24:
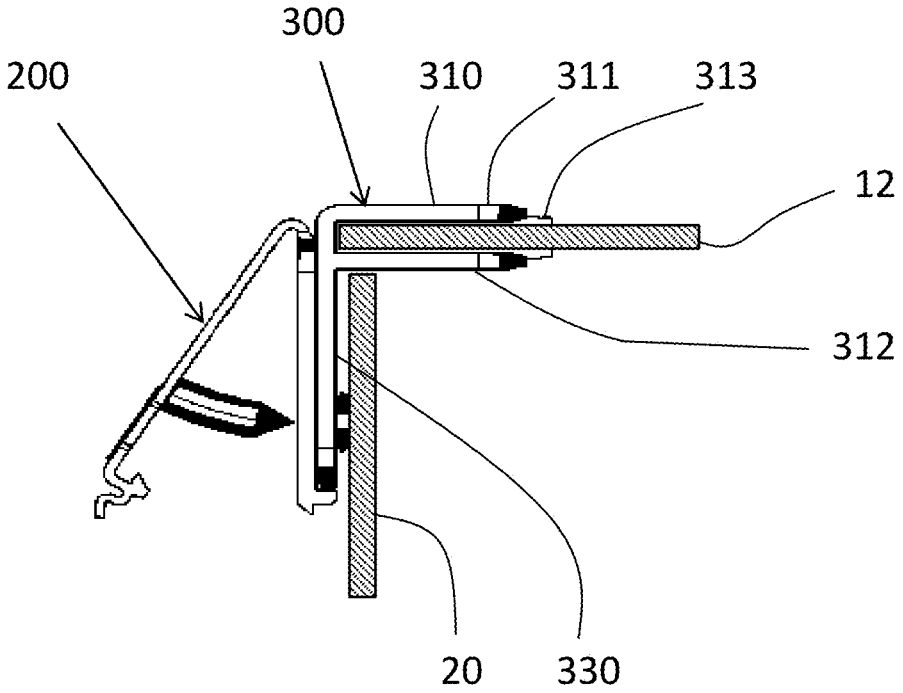
FIG. 24 is a close up view showing a box fastener aligned relative to a box.

FIG. 17 shows a partial close up cross-sectional view of the right side of the fastener 100 showing the flap 12 between the top piece 160 and bottom piece 170 of the fastener, with the tooth 250 of the anchor piercing the fastener. The inner end 162 and outer end 163 of rail 161 is engaged by lips 213 and 214 of the anchor, respectively. The securing ring 221 is retained within hole 164 as well.

The first and second sides, 120 and 150, respectively, are preferably mirror images of each other on opposite sides of the web 110.

Turning now to FIGS. 1-8, it is seen that a preferred embodiment of an anchor 200 is illustrated. The anchor 200 has a base 210 having a first end 211 and a second end 212. Two lips 213 and 214 are provided. The lips 213 and 214 depend from the bottom side of the base 210 and are generally parallel to each other and generally perpendicular to a longitudinal axis of the base 210. A hole 220 passes through the base 210. The hole 220 is preferably circular and is located between the lips 213 and 214, respectively. The hole 220 is aligned with a securing ring 221 having a first side piece 222 with a rim 223 and also a second side piece 224 with a rim 225. The rims 223 and 225 form a generally circular structure formed of two separate semi-circles. A flange 230 is at the second end 212, or distal end, of the base. The flange 230 has in inwardly angled top surface.

The anchor 200 further has an arm 240. The arm 240 has a first end 241 and a second end 242. A tooth 250 depends from the arm 240 between the ends 241 and 242. The tooth 250 has a body 251 that is preferably curved along its length between ends 252 and 253. A piercing element 254 is at end 253. The piercing element 254 can be a pointed end that is suitable for piercing a surface. It is understood that while the tooth 250 is illustrated to have a certain length and thickness, that these parameters may differ for specific purposes (type and thickness of box, piercing into or through the box, for example) without departing from the broad aspects of the present invention. A lock 260 is further provided having a flange 261 and a release 262. The flange 261 has an angled face. The tooth is shown to have a generally round profile, but could have alternative profiles without departing from the broad aspects of the present invention.

In use, the arm 240 is pivotable relative to the base 210. End 211 of the base 210 is preferably formed integral with end 241 of the arm 240. It is understood that the base 210 and arm 240 could alternatively be formed of separate but joined components without departing from the broad aspects of the present invention. The radius of curvature of the tooth body 251 is preferably equal to the radius of the arc through which the tooth passes as the arm 240 is swung or rotated relative to the base 210. In this regard, the tooth 250 can be received through the circular hole 220. The tooth 250 can be locked in hole 220 when the lock 260 engages the flange 230 at the distal end 212 of the base. This locked arrangement is shown particularly well in FIGS. 7 and 8. The angled face of flange 261 passes the angled face of flange 230, whereby the flanges then lock together. The release 262 is operable to remove this locking engagement of the flanges wherein the arm 240 can be rotated away from the base thereby removing tooth 250 from the hole 220.

Turning back now to FIGS. 12-17, it is seen that two anchors 200 are used with the box fastener 100, with one anchor being used on each side of the fastener. One anchor 200 straddles the outer rail 131 of the box fastener 100. In this regard, lip 213 is adjacent the inner end 132 and the lip 214 is adjacent the outer end 133. The securing ring 211 is aligned with and passes through hole 134. Ring 221 (when in its normal uncompressed state) has a diameter that is greater than the diameter of hole 134. In this regard, the box fastener anchor is both laterally (across rail) and longitudinally (along the length of the rail) secured to the box fastener. The anchor is selectably removable from the box fastener by forcing the sides 222 and 224 together (to decrease the ring diameter to a size smaller than the hole diameter) and removing the securing ring 221 from the hole 134. It is appreciated that an anchor is similarly removably securable to the outer rail 161 on the second side 150 of the box fastener.

Looking now at FIGS. 9-11, it is seen how the box fastener 100 with anchors 200 is used to fasten or secure the top 10 and bottom 15 of the box. The outer flaps are secured between the top piece 130 and bottom piece 140 of the fastener 100. Then, the anchor 200 (on each side) is closed whereby the piercing element passes into or through the flap in an arched path. In one embodiment, the tooth passes into and through the flap in the arched path whereby it is resistant to being removed by a completely vertical force. The anchor 200 fixes the box in position relative to the fastener 100 whereby the box flaps on each side of the box cannot move relative to the fastener 100 and relative to each other and tenting is therefore prevented and/or reduced. It is also understood that the piercing element could be fully retained within the box or flap when the anchor is in the fastened or closed position thereby preventing the sharp piercing element from entering into the inside of the box.

Turning now to FIGS. 18-24, it is seen that a second embodiment of a box fastener 300 is illustrated. The fastener 300 has a top 310 with an upper piece 311 and a lower piece 312, the upper piece and lower piece being separated by a central web 313. The upper piece 311 and lower piece 312 have inward facing faces, respectively, that are preferably generally flat and parallel to each other. A side 330 is further provided. The side 330 is preferably flat and is preferably perpendicular to the top 310. The side 330 has ends 331 and 332. Two slots 333 and 334 are longitudinally (relative to the length of the side) aligned on the side 330. Two holes 335 and 336 are further provided. Slot 333 and hole 335 are at one end 331 of the side 330 and slot 334 and hole 336 are at the other end 332 of the side. An anchor 200 can interface with each slot and hole combination. Specifically, the first lip 213 can pass through slot 333 and the securing ring 221 can pass through hole 335, and the other lip 214 can engage the outer face of the side. Likewise, the first lip of another anchor can pass through slot 334 and the securing ring 221 can pass through hole 335.

The web 313 or partition separates the upper piece 311 and the lower piece 312 into two pockets that can receive corners of box flaps.

Looking at FIGS. 9-11 and 24, it is seen that the fastener 300 is used to secure to a box 5. Two flaps are contained between the upper piece 311 and lower piece 312 of the top 310 on opposite sides of the web 313. This provides side-to-side stability for the fastener 300. Then, the inner face of the side 330 is positioned on the side of the box 5. The anchors 200 are then closed securing the fastener to the box. With the fastener secured to the box, the top 310 of the fastener 300, and accordingly the flaps of the box 5, cannot move vertically thereby securing the box in the closed position. It is appreciated that a single anchor could be used on the side without departing from the broad aspects of the present invention.

Figure 25:
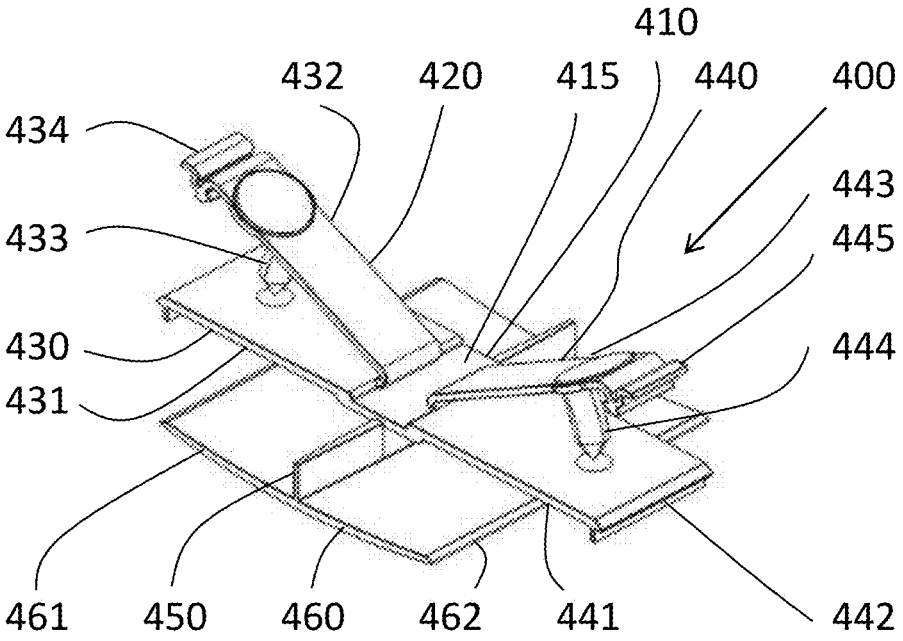
FIG. 25 is a perspective view of an alternative embodiment of the present invention.
Figure 26:
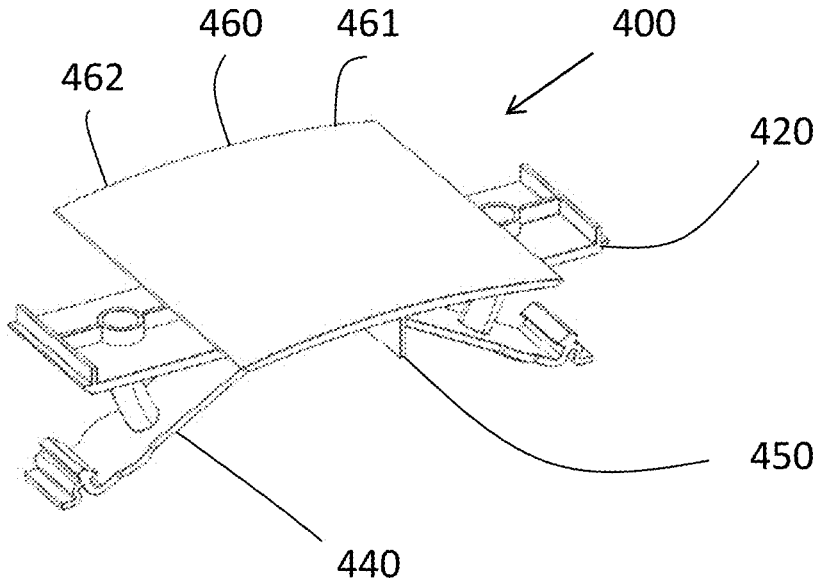
FIG. 26 is an additional perspective view of the embodiment illustrated in FIG. 25.
Figure 27:
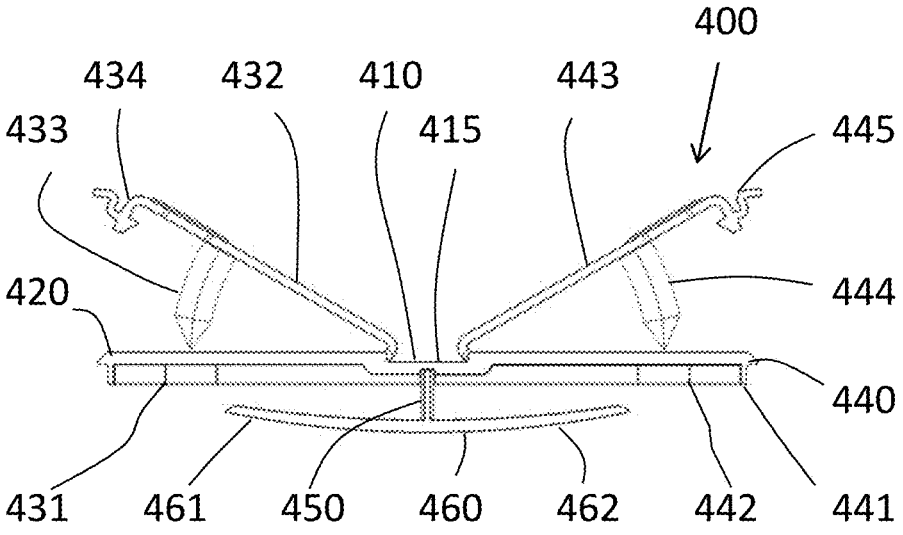
FIG. 27 is a side view of the embodiment illustrated in FIG. 25.

Turning now to FIGS. 25-27, it is seen that a further preferred embodiment of the present invention is illustrated. In this regard, an integrated fastener 400 is provided. Fastener 400 has a top 410 having a hub 415. The top 410 has a first side 420 with an integrated anchor 430 having a base 431, an arm 432 a tooth 433 and a lock 434. The anchor 430 functions similar to the anchor described above, but is preferably formed in an integral process with the fastener 400. The top 410 has a second side 440 also having an integrated anchor 441 with a base 442, an arm 443, a tooth 444 and a lock 445. Each anchor is independently lockable and unlockable. The fastener 400 further has a web 450 and a bottom 460. The bottom 460 has a first side 461 and a second side 462. Sides 461 and 462 are preferably deformable away from their static position whereby they can resiliently come into contact with flaps of the box. The web 450 preferably is between the flaps of the box when the fastener 400 is in position. The box flaps are held in position between the top 410 and bottom 460.

Figure 28:
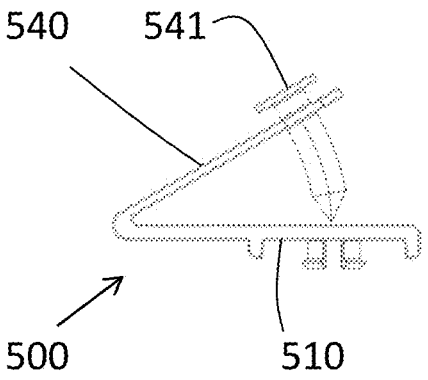
FIG. 28 is a side view of an alternative embodiment of an anchor.
Figure 29:
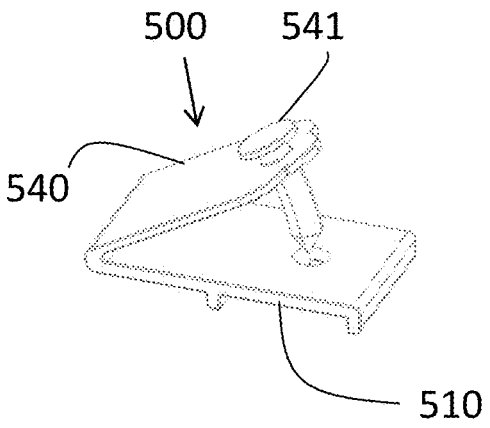
FIG. 29 is a perspective view of the embodiment illustrated in FIG. 28.

Turning now to FIGS. 28 and 29, it is seen that an alternative design of an anchor 500 is provided. Anchor 500 has a base 510 and an arm 540. A raised engagement area 541 is provided on the distal end of the arm 540. The engagement area 541 provides a place for a user to apply a force to the arm 540 when fastening the anchor. Also, the engagement area has a rim that a user can engage when unfastening the anchor.

Figure 30:
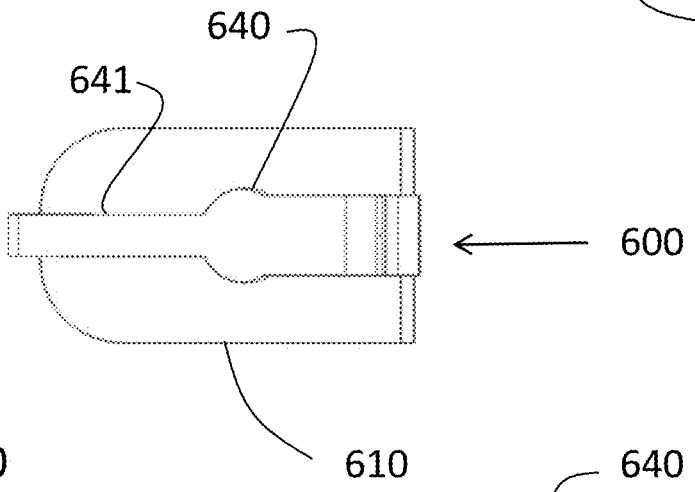
FIG. 30 is a top view of an alternative embodiment of an anchor.
Figure 31:
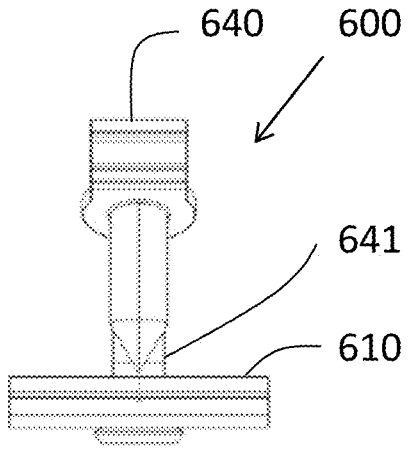
FIG. 31 is an end view of the embodiment illustrated in FIG. 30.

Turning now to FIGS. 30 and 31, it is seen that a further alternative design of an anchor 600 is provided. The anchor 600 has a base 610 and an arm 640. The arm 640 has a thin profile section 641. This embodiment is useful in light duty situations and saves material, weight and cost.

Turning now to FIGS. 32-35, it is seen that a further alternative embodiment of a fastener 700 is illustrated. Fastener 700 has a top 710 with opposed ends 711 and 712. A slot 713 and a hole 715 are near end 711. A slot 714 and a hole 716 are near end 712. A flange 720 or central wall is preferably generally equidistant between ends 711 and 712. Slots 713 and 714 are preferably generally parallel to each other and perpendicular to the longitudinal or lengthwise axis of the top. A side 730 is also provided. Side 730 is preferably generally perpendicular to the top 710. The side 730 has ends 731 and 732. A slot 733 and a hole 735 is near end 731. A slot 734 and a hole 735 is near end 732. Slots 733 and 734 are preferably generally parallel to each other and also generally parallel to the longitudinal axis of the side. Slots 733 and 734 are accordingly generally perpendicular to slots 713 and 714. The fastener can interface with four anchors 200. As seen in FIG. 35, the anchors on the side can penetrate the side of the box, and the anchors on the top can penetrate both the major and minor flaps of the box. Side anchors prevent vertical movement of the fastener relative to the box. Top anchors prevent movement between the fastener and the flaps of the box.

It is understood that while slots and anchors are illustrated in preferred embodiments to be oriented certain ways, that they may be alternatively positioned or oriented without departing from the broad aspects of the present invention.

Figure 36:
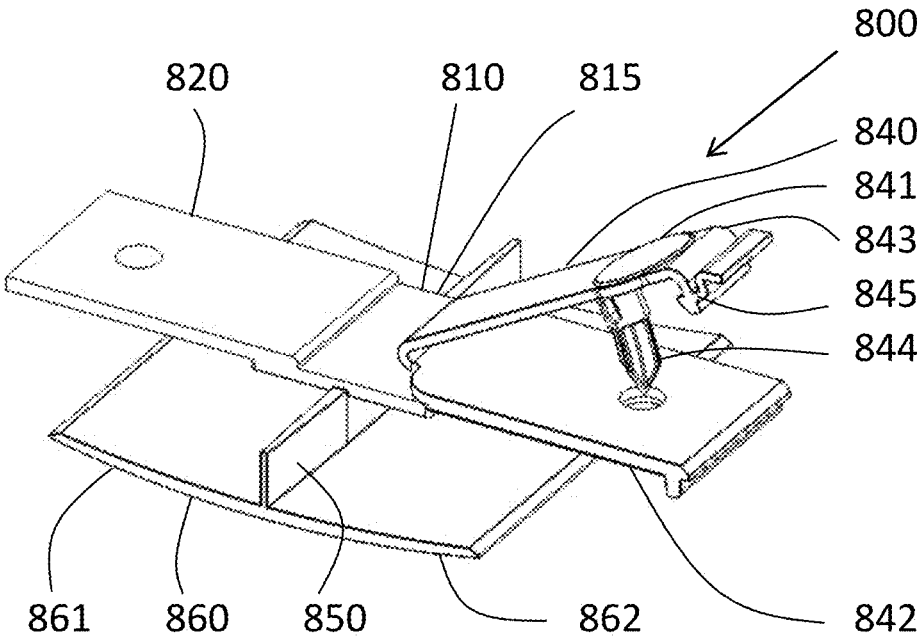
FIG. 36 is similar to FIG. 25, but illustrates an alternative embodiment having a single anchor.
Figure 37:
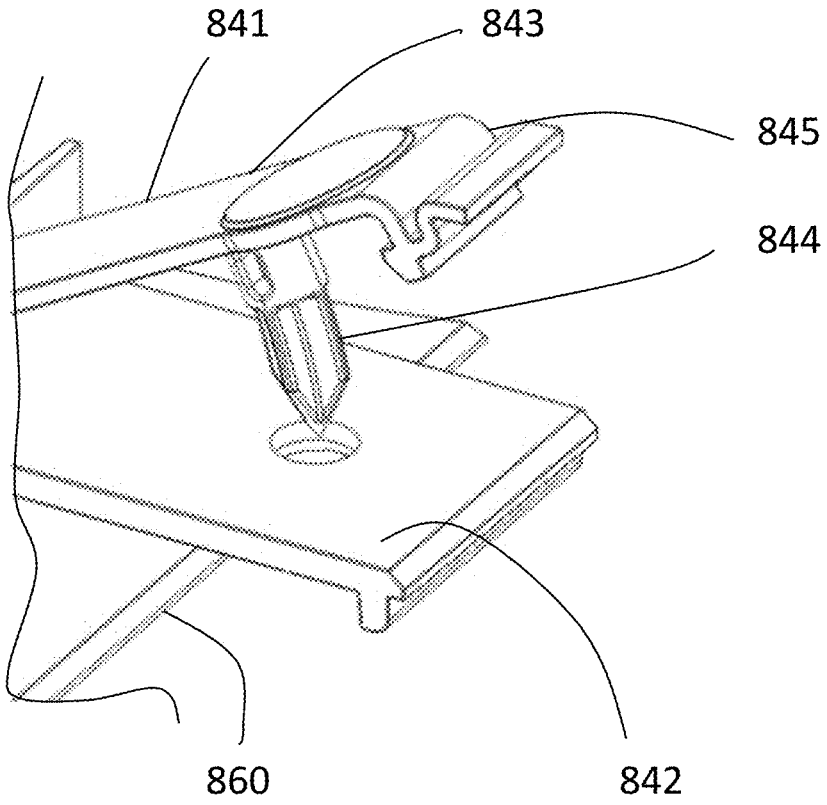
FIG. 37 is a close up view of a portion of the embodiment illustrated in FIG. 36.

Turning now to FIGS. 36 and 37, it is seen that a further preferred embodiment of the present invention is illustrated. In this regard, an integrated fastener 800 is provided. Fastener 800 has a top 810 having a hub 815. The top 810 has a first side 820 without an integrated anchor. The top 810 has a second side 840 also having an integrated anchor 841 with a base 842, an arm 843, a tooth 844 and a lock 845. The fastener 800 further has a web 850 and a bottom 860. The bottom 860 has a first side 861 and a second side 862. Sides 861 and 862 are preferably deformable away from their static position whereby they can resiliently come into contact with flaps of the box. The web 850 preferably is between the flaps of the box when the fastener 800 is in position. This embodiment illustrates how a single integrated anchor can be used to secure the box in a closed position. The box flaps are held in position between the top 810 and bottom 860.

It is also appreciated that tooth 844 has an alternative profile in this embodiment. The tooth 844 has a generally cross-shaped profile in that would walls join at an intersection whereby each wall is generally 90 degrees separated from its respective adjacent walls. This structure advantageously is structurally strong yet light weight. It also reduces the profile of the piercing hole. It is appreciated that other profiles, such as but not limited to square, polygon, crescent or otherwise, without departing from the broad aspects of the present invention.

Figure 38:
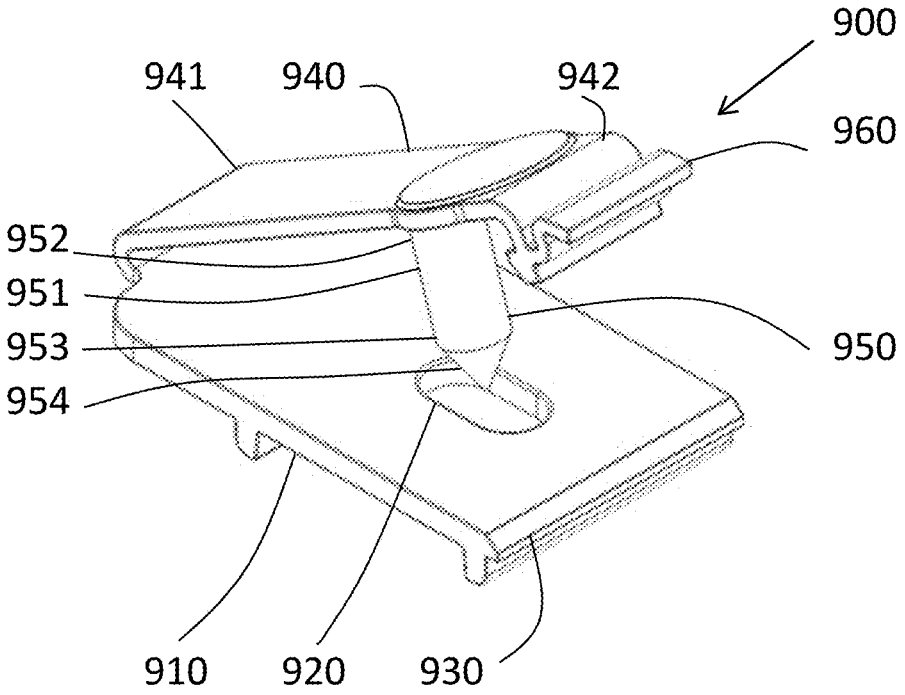
FIG. 38 is a perspective view of an alternative embodiment of the present invention.
Figure 39:
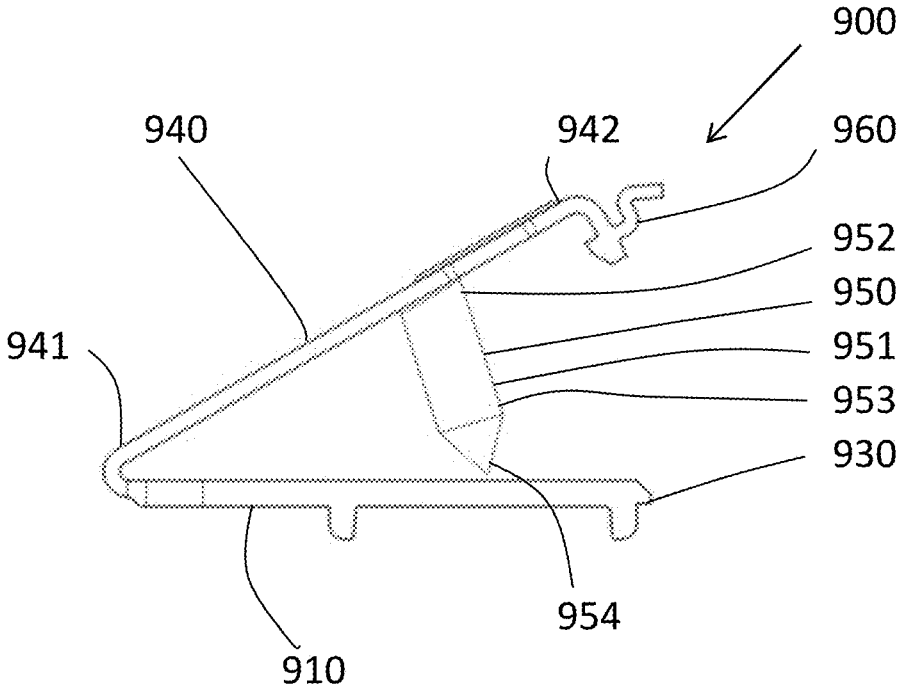
FIG. 39 is a side view of the embodiment illustrated in FIG. 38.
Figure 40:
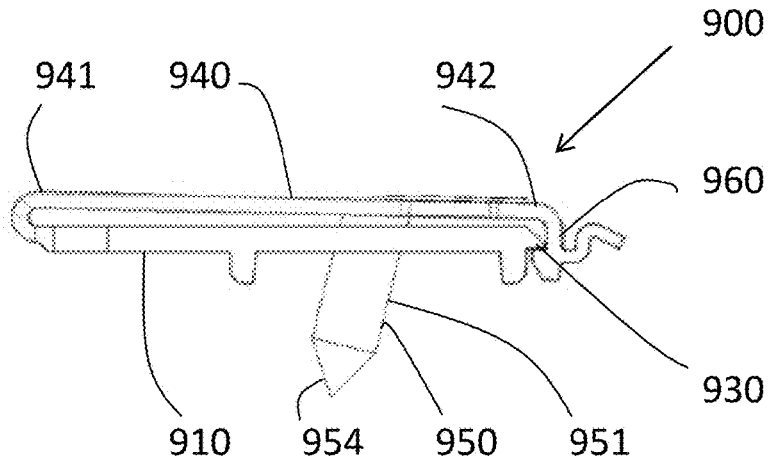
FIG. 40 is similar to FIG. 39 but is illustrated in a closed position.

Turning now to FIGS. 38-40, it is seen that a further embodiment of an anchor 900 is illustrated. The anchor 900 has a base 910 having a first end and a second end. A hole 920 passes through the base 910. The hole 920 is preferably oversized relative to the tooth profile, and can be generally slot shaped. A retaining or structural support structure can be provided on the bottom side of the base. A flange 930 is at the second end, or distal end, of the base. The flange 930 has in inwardly angled top surface.

The anchor 900 further has an arm 940. The arm 940 has a first end 941 and a second end 942. A tooth 950 depends from the arm 940 between the ends 941 and 942. The tooth 950 has a body 951 that is preferably generally straight along its length between ends 952 and 953. A piercing element 954 is at end 953. The piercing element 954 can be a pointed end that is suitable for piercing a surface. It is understood that while the tooth 950 is illustrated to have a certain length and thickness, that these parameters may differ for specific purposes (type and thickness of box, piercing into or through the box, for example) without departing from the broad aspects of the present invention. A lock 960 is further provided having a flange and a release. The flange has an angled face. The tooth is shown to have a generally round profile, but could have alternative profiles without departing from the broad aspects of the present invention.

The arm 940 is pivotally connected to the base 910. In this regard, the tooth 950 is received within the hole 920 as the arm 940 is swung towards the base 910. The elongated hole 920 can receive the tooth 950 even though the tooth is straight in this embodiment. The tooth 950 can be locked in hole 920 when the lock 960 engages the flange 930 at the distal end of the base. The angled face of the flange passes the angled face of flange 930, whereby the flanges then lock together. The release is operable to remove this locking engagement of the flanges wherein the arm 940 can be rotated away from the base thereby removing tooth 950 from the hole 920.

Figure 41:
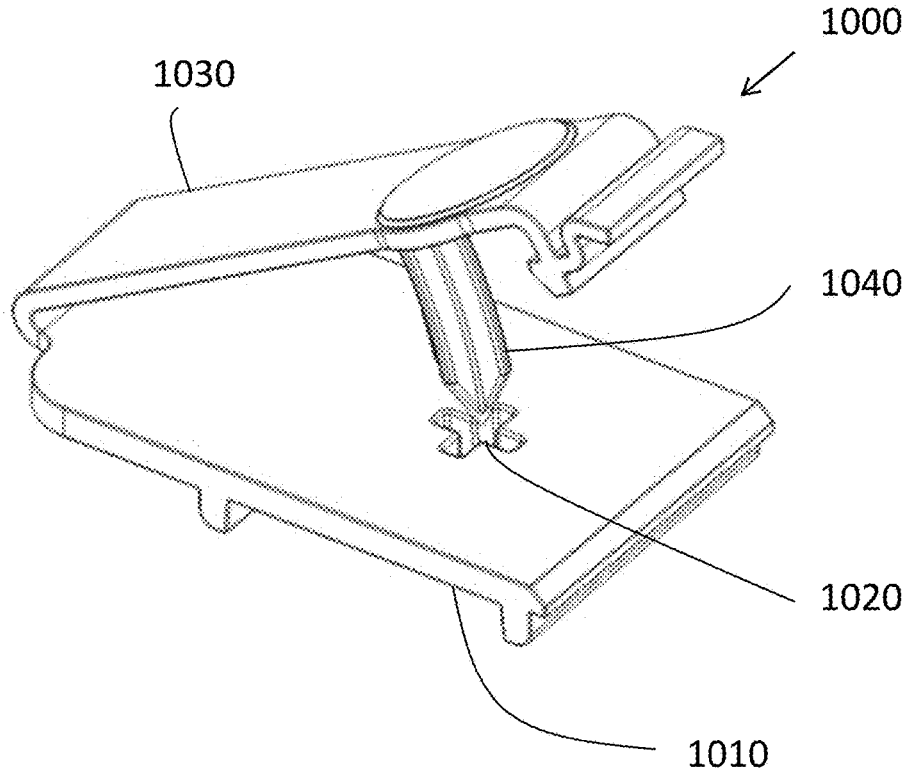
FIG. 41 is a view of an alternative embodiment of the present invention showing a base having generally cross-shaped hole.

Turning now to FIG. 41, it is seen that a further embodiment of an anchor 1000 is illustrated. The anchor 1000 has a base 1010 with a hole 1020 there through. The hole 1020 is a generally cross-shaped hole. An arm 1040 with a tooth 1050 is further provided. The tooth 1050 is generally cross-shaped and is curved along its length. The tooth 1050 is adapted to be received through hole 1020.

Thus it is apparent that there has been provided, in accordance with the invention, a box fastener anchor that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An anchor for use with a box fastener having an outer rail with an outer rail hole therethrough, an inner side edge and an outer side edge, said anchor comprising:

a base having:

a bottom;

a first lip, a second lip and a securing ring connected to said bottom; and a base hole therethrough; and an arm containing a tooth, said tooth being selectably insertable through said base hole, wherein said anchor is secured to the box fastener by insertion of said securing ring through the outer rail hole while said first lip is adjacent to the inner side edge and said second lip is adjacent to the outer side edge.

2. The anchor of claim 1 wherein said arm is pivotally connected to said base, said arm being lockable in a closed position relative to said base.

3. The anchor of claim 2 wherein said tooth is curved.

4. The anchor of claim 2 wherein:

said base has a base flange at a base end; and said arm has a lock with an arm flange that selectably engages said base flange to lock said arm in position relative to said base with said base flange and said arm flange in a locking engagement, said lock further having a release that is selectably used to release said locking engagement of said arm flange and said base flange.

5. The anchor of claim 1 wherein said base is removably connectable to the box fastener.

6. An anchor for use with a box fastener and comprising:

a base with a base hole therethrough, said base further having a base flange at a base end, said base further comprising a securing ring, said securing ring being concentric with said base hole; and an arm, said arm having a distal end with a tooth near said distal end, said tooth passing through said base hole when said arm is in a closed position, said arm further having a lock with an arm flange that selectably engages said base flange to lock said arm in an arm position relative to said base with said base flange and said arm flange in a locking engagement wherein said tooth is retained in a tooth position through said base hole, said lock further having a release that is selectably used to release said locking engagement of said arm flange and said base flange so that said tooth is removable from said base hole.

7. The anchor of claim 6 wherein:

said tooth is a curved tooth; and said base hole is generally round.

8. The anchor of claim 6 wherein said tooth has a generally round profile.

9. The anchor of claim 6 wherein said tooth has a generally cross-shaped profile.

10. The anchor of claim 4, wherein:

said base flange has a base flange angled face;

said arm flange has an arm flange angled face; and said locking engagement occurs when said arm flange angled face passes said base flange angled face.

11. The anchor of claim 1, wherein said first lip is parallel to said second lip.

12. The anchor of claim 1, wherein said securing ring is concentric with said base hole and is located between said first lip and said second lip.

13. The anchor of claim 1, wherein said securing ring is comprised of two pieces.

14. The anchor of claim 6, wherein said base has a first lip and second lip on a base bottom.

15. The anchor of claim 14, wherein said first lip is parallel to said second lip, and said first lip and said second lip are on opposite sides of said base hole.

16. The anchor of claim 15, wherein:

said base flange has a base flange angled face;

said arm flange has an arm flange angled face; and said locking engagement occurs when said arm flange angled face passes said base flange angled face.

* * * * *